US006288390B1

(12) United States Patent
Siuzdak et al.

(10) Patent No.: US 6,288,390 B1
(45) Date of Patent: Sep. 11, 2001

(54) DESORPTION/IONIZATION OF ANALYTES FROM POROUS LIGHT-ABSORBING SEMICONDUCTOR

(75) Inventors: Gary E. Siuzdak, San Diego, CA (US); Jillian Buriak, West Lafayette, IN (US); Jing Wei, La Jolla, CA (US)

(73) Assignee: Scripps Research Institute, La Jolla, CA (US)

( * ) Notice: Subject to any disclaimer, the term of this patent is extended or adjusted under 35 U.S.C. 154(b) by 0 days.

(21) Appl. No.: 09/520,251

(22) Filed: Mar. 7, 2000

Related U.S. Application Data

(60) Provisional application No. 60/123,503, filed on Mar. 9, 1999.

(51) Int. Cl.[7] ..... H01J 49/04
(52) U.S. Cl. ..... 250/288
(58) Field of Search ..... 250/288

(56) References Cited

U.S. PATENT DOCUMENTS

| | | | | |
|---|---|---|---|---|
| 4,988,879 | * | 1/1991 | Zare et al. | 250/288 |
| 5,376,788 | * | 12/1994 | Standing et al. | 250/288 |
| 5,561,304 | | 10/1996 | Canham et al. | 257/103 |
| 5,580,434 | * | 12/1996 | Robotti et al. | 250/288 |
| 5,719,060 | * | 2/1998 | Hutchens et al. | 250/288 |
| 5,770,272 | | 6/1998 | Biemann et al. | 427/421 |
| 5,770,860 | * | 6/1998 | Frazen | 250/288 |
| 5,777,324 | | 7/1998 | Hillenkamp | 250/288 |
| 5,828,063 | | 10/1998 | Koster et al. | 250/288 |
| 5,854,486 | | 12/1998 | Dreyfus | 250/288 |
| 5,859,431 | * | 1/1999 | Cotrell et al. | 250/288 |
| 5,882,496 | * | 3/1999 | Northrup et al. | 204/601 |
| 5,896,832 | | 2/1999 | Wang et al. | 250/288 |
| 6,020,208 | | 2/2000 | Hutchens et al. | 436/174 |
| 6,124,137 | | 9/2000 | Hutchens et al. | 436/155 |

FOREIGN PATENT DOCUMENTS

| | | | |
|---|---|---|---|
| 0 617 048 A1 | * | 9/1994 | (EP) . |
| WO 95/16280 | | 6/1995 | (GB) . |

OTHER PUBLICATIONS

Amato et al., *Absorption and Photoluminescence*, Chapter 1 in Optoelectronic Properties of Semiconductors and Superlattices.

Behren et al., *Absorption coefficient of porous silicon*, 229–233 (1997).

(List continued on next page.)

*Primary Examiner*—Jack Berman
(74) *Attorney, Agent, or Firm*—Welsh & Katz, Ltd.

(57) ABSTRACT

A method for desorption and ionization of an analyte from a porous, light absorbing, semiconductor is disclosed that can be used to replace conventional mass-assisted laser desorption/ionization (MALDI) in the mass spectrometry of proteins and biomolecules. The process uses the semiconductor to trap an analyte on the semiconductor. The semiconductor is illuminated by a light source and absorbs the light energy. The semiconductor then uses the light energy is to desorbed and ionize the analyte. The analyte so desorbed and ionized is suitable for detection by mass analyzers.

65 Claims, 5 Drawing Sheets

OTHER PUBLICATIONS

Buriak, et al., *J. Am. Chem. Soc.* 1998. 120, 1339–1340.
Canham, *Appl. Phys. Lett.* 57, 1046 (1990).
Canham, *Properties of Porous Silicon*, pp. 83–88 (Canham, ed. The Institution of Electrical Engineers, London, 1997).
Cullis, et al., *J. Appl. Phys.* 82, 9909–965 (1997).
Doan, et al., *Appl. Phys. Lett.* 60, 619–620 (1992).
Herino, et al. *J. Electrochem. Soc.* 134, pp. 1994–2000 (1987).
Hrubowchak, et al., *Anal. Chem.* 63, 1947–1953 (1991).
Itakura, et al., *Appl. Phys. Lett.* 61, 46–48 (1992).
Jung, et al., *J. Electrochem. Soc.* 140, 3046 (1993).
Karas, et al., *Anal. Chem.* 60, 2299–2301 (1988).
Knockenmuss, et al., *Rapid Comm. in Mass Spectrom.* 10, 871–877 (1996).
Lidgard, et al., *Rapid Comm. in Mass Spectrom.* 9, 128–132 (1995).
Liu, et al. *Anal. Chem.* 53, 109 (1981).
Macfarlane, et al., *Science* 191, 920–925.
Nakajima, et al., *Appl. Phys. Lett.* 61, 46 (1993).
O'Donnell, et al., *Analytical Chemistry* 69, 2438–2443 (1997).
Ogata, et al., *Analytical Chemistry* 69, 2438–2443 (1997).
Peter, et al., *Appl. Phys. Lett.* vol. 66, no. 18 pp. 2355–57 (1995).
Petrova–Koch, et al., *Appl. Phys. Lett.* 61, 943 (1992).
Posthumus, et al., *Anal. Chem.* 66, 1739 (1994).
Rouquerol, et al., *Pure Appl. Chem.* 66, 1739 (1994).
Sailor, *Adv. Matter,* 1997, 9, No. 10.
Schmuki, et al., *Phys. Rev. Lett.* 80, 4060–4063 (1998).
Stewart, et al., *Angew. Chem, Int. Ed.* 37, 3257–3261 (1998).
Varakin, et al., *High Energy Chemistry* 28, 406–411 (1994).
Wang, et al., *Appl. Surf. Sci.* 93, 205–210 (1996).
Whall, et al., *Journal of Materials Science,* 6 (1995) 149–264.
Zenobi, R. *Chimia* 51, 801–803 (1997).
Zhan, et al., *J. Am. Soc. Mass Spec.* 8, 525–531 (1997).

* cited by examiner

DESORPTION/IONIZATION OF ANALYTES FROM POROUS LIGHT-ABSORBING SEMICONDUCTOR

This Application claims benifits of provisional No. 60/123,503 filed Mar. 9, 1999.

GOVERNMENT RIGHTS

This invention was made with government support under Grant No. 1R01 GM55775-01A1 awarded by the National Institutes of Health. The government has certain rights in the invention.

TECHNICAL FIELD

The field of the subject invention is mass spectrometry and more particularly the invention pertains to the facilitation of mass spectrometry through the desorption and ionization of an analyte.

BACKGROUND OF THE INVENTION

Mass spectrometry is used to measure the mass of a sample molecule, as well as the mass of the fragments of a sample to identify that sample. The simplest mass spectrometers introduce a gaseous, electrically neutral sample in vacuo, normally at pressures of $10^{-6}$ torr or less. Silverstein, et al, *Spectrometric Identification of Organic Compounds*, p.7 (John Wiley & Sons, Inc. 1963). The sample then passes through an electron beam.

The fast-moving electrons from the electron beam strike electrons on the sample being studied, ejecting one or more electrons from the sample. After a subject sample molecule has lost an electron, the sample has a net positive charge, or is "ionized."

Mass spectrometry measures the ratio of the mass of the molecule to the ion's electric charge. The mass is customarily expressed in terms of atomic mass units, called Daltons. The charge or ionization is customarily expressed in terms of multiples of elementary charge. The ratio of the two is expressed as a m/z ratio value (mass/charge or mass/ionization ratio). Because the ion usually has a single charge, the m/z ratio is usually the mass of the ion, or its molecular weight (abbreviated MW). Often, the terms m/z, the mass of the sample in Daltons (or molecular weight, abbreviated MW) are used interchangeably.

One way of measuring the mass of the sample accelerates the charged molecule, or ion, into a magnetic field. The sample ion moves under the influence of the magnetic field. A detector can be placed at the end of the path through the magnetic field, and the m/z of the molecule calculated as a function of the path through the magnetic field and the strength of the magnetic field.

Another method of measuring the mass of the sample is time-of-flight (TOF). TOF accelerates the sample ion with a known voltage, and measures how long it takes a sample ion, or the sample ion's fragments if the sample breaks down, to travel a known distance.

Yet another method, quadrupole mass analysis, rapidly alternates the magnetic polarities of pairs of magnetic poles permitting only sample molecules with a narrow range of masses to reach a detector.

Post source decay (PSD) studies are an extension of time-of-flight measurements. In a time-of-flight study, the sample can break into pieces, or fragment, after ionization and acceleration. When the sample fragments after it has been accelerated by the voltage, the resulting pieces, or fragments, all travel at the same speed, and therefore arrive at the detector at the same time as the unbroken sample would have arrived. The fragmentation of the sample can be studied by reflecting the sample ion with a repelling electric field. The reflected ions have different speeds that depend on their different masses. The mass of the reflected fragments can then be measured to better understand the molecular structure of the sample.

Molecules that are not easily rendered gaseous are more difficult to study with mass spectrometry. Accordingly, modern advances in mass spectroscopy often address problems regarding the handling of liquid or solid samples. When a molecule is 'on' a substrate, the sample is adsorbed to that substrate. Desorption is the process by which a molecule adsorbed on a substrate is removed from the substrate. Removing a molecule from a surface is "desorbing" a molecule from that surface. Instead of starting with a gaseous sample, as basic mass spectrometry does, desorption mass spectrometry starts with the sample adsorbed on a substrate.

Desorption mass spectrometry has undergone significant improvements since the original experiments by Thomson were performed over ninety years ago. Thomson, *Philosophical Magazine* 20, 752 (1910).

The most dramatic change occurred in the early 1980's with the introduction of an organic matrix as a vehicle for desorbing and ionizing a sample. Liu, et al., *Anal. Chem.* 53, 109 (1981); Barber, et al., *Nature* 293, 270–275(1981); Karas, et al., *Anal. Chem.* 60, 2299–2301 (1988). Rather than using an electron beam to ionize a sample, MALDI ionizes a sample by transferring a proton from the organic matrix to the sample as part of the vaporization process. Although the electron beam ionization processes of the past can be useful for certain easily studied molecules, it is inadequate for modern studies. The development of proton transfer ionization has made biomolecular mass spectroscopy possible.

The broad success of matrix-assisted laser desorption/ionization (MALDI) is related to the ability of the matrix to incorporate and transfer energy to the sample. Barber, et al., *Nature* 293, 270–275 (1981); Karas, et al., *Anal. Chem.* 60, 2299–2301 (1988); Macfarlane, et al., *Science* 191, 920–925 (1976); Hillenkamp, et al., *Anal. Chem.* 63, A1193–A1202 (1991). For instance, in MALDI the sample is typically dissolved into a solid, ultraviolet-absorbing, crystalline organic acid matrix that vaporizes upon pulsed laser radiation, carrying the sample with the vaporized matrix. Karas, et al., *Anal. Chem.* 60, 2299–2301 (1988); Hillenkamp, et al., *Anal. Chem.* 63, A1193–A1202 (1991).

Direct desorption/ionization without a matrix has been extensively studied on a variety of substrates. For examples see: Zenobi, R. Chimia 51, 801–803 (1997); Zhan, et al., *J. Am. Soc. Mass Spec.* 8, 525–531 (1997); Hrubowchak, et al., *Anal. Chem.* 63, 1947–1953 (1991); Varakin, et al., *High Energy Chemistry* 28, 406–411 (1994); Wang, et al., *Appl. Surf. Sci.* 93, 205–210 (1996); and Posthumus, et al., *Anal. Chem.* 50, 985–991 (1978). Such procedures have not yet been widely used because of rapid molecular degradation and fragmentation usually observed upon direct exposure to laser radiation.

Further, salts and buffers can be detrimental to mass spectroscopy analyses. Biomolecular analysis in general and protein analysis in particular is subject to these limitations. Salts and buffers and can cause problems when only small quantities of sample are available, as sample can be lost in attempting to purify the sample. Moreover, salts normally form adduct peaks in a mass spectrum that compete with the peaks of the molecular ion dividing and broadening the overall signal. High pH value buffers can also interfere with ionization of the sample in MALDI or electrospray ionization (ESI) techniques.

ESI ionizes a sample by spraying and evaporating a highly electrically charged liquid containing the sample. ESI is sensitive to salts and buffers, with concentrations of salts and buffers over approximately one millimolar (mM) presenting problems. The common sodium and potassium ions in particular are a problem for ESI at concentrations above 10 mM. Although MALDI is not as sensitive to salts and buffers as ESI, MALDI is sensitive to salts and buffers, with concentrations of salts and buffers less than 10 mM being recommended for MALDI. Nevertheless, in MALDI, salts and buffers can interfere with the formation of the matrix crystal, and result in loss of signal.

MALDI is also severely limited in the study of small molecules. The MALDI matrix interferes with measurements below a m/z of approximately 700, called the low-mass region, which varies somewhat depending on the matrix used. Although MALDI-MS (matrix assisted laser ionization/desorption mass spectrometry) analysis can be utilized for small molecules as has been demonstrated by Lidgard, et al *Rapid Comm. in Mass Spectrom.* 9, 128–132 (1995) and matrix suppression can be achieved under certain circumstances as demonstrated by Knochenmuss, et al, *Rapid Comm. in Mass Spectrom.* 10, 871–877 (1996), matrix interference presents a real limitation on the study of the low-mass region via MALDI-MS. Siuzdak, *Mass Spectrometry for Biotechnology*, 162 (Academic Press, San Diego, 1996). Wang, et al, U.S. Pat. No. 5,869,832 recognize that there are few compounds that can form crystals that incorporate proteins, absorb light energy, and eject and ionize the protein intact.

Even with large molecules, MALDI has significant limitations. The matrix and matrix fragments can form adducts with the sample ion. The presence of adducts in a MALDI study can cause the measured signal to have a range of molecular weights. The range of molecular weights caused by the adducts results in a broadening the sample signal over a range of molecular weights. The broadening appears in a spectrum by the sample's peak height being substantially shortened when compared to the peak height of a non-broadened signal for the molecular ion of the sample.

In addition to the limitations MALDI has in studying molecules by direct measurements, MALDI is also limited in studying the Post Source Decay (PSD) of molecules. In MALDI, the vaporized matrix molecules of the sample interfere with the measurement of the fragments after reflection, rendering MALDI impractical even for molecules with a molecular weight over 700 Daltons.

Mass spectrometry is not the only field of study where generating ions is an important step for biomolecular analysis. Similar challenges are faced in electromagnetic spectroscopy of biomolecular ions.

Secondary ion mass spectrometry (SIMS) has had a profound effect on surface science as described by Benninghoven, et al., *Secondary Ion Mass Spectrometry*, 1227 (John Wiley & Sons, 1987). Indeed, U.S. Pat. No. 5,834,195 teaches that SIMS can be used to assay for the mass of an analyte that is covalently bonded to a substrate surface.

It would be beneficial to have a direct laser desorption/ionization technique for use in biomolecular and other analyses that addresses the needs still unfulfilled by the present methods for dramatically simplified sample preparation; i.e., an absence of a matrix or the need for covalent linkage of the analyte to the substrate, substrates tailored to the needs of a particular sample, and a tolerance for salts and buffers. The present invention addresses some of these needs highlighted by the limitations of current methods, and offers further benefits that are described herein.

BRIEF SUMMARY OF THE INVENTION

The present invention relates to an improved method and apparatus for ionizing an analyte (the substance or sample being assayed) from porous light-absorbing semiconductors and then analyzing the ionized analyte.

One aspect of this invention contemplates a method for providing an analyte ion suitable for analysis of a physical property. That method comprises the following steps:

(a) obtaining a porous light-absorbing semiconductor substrate;

(b) introducing a quantity of an analyte having a physical property to be determined to said substrate to form an analyte-loaded substrate; and (d) irradiating the analyte-loaded substrate under reduced pressure to provide an ionized analyte. Thus, once ionized under reduced pressure, the analyte ion is suitable for analysis to determine a desired physical. Analyzing the analyte comprises one or more physical methods of analysis that illustratively include mass spectrometry, electromagnetic spectroscopy, chromatography, and other methods of physical analysis known to skilled workers.

In accordance with another aspect of this invention, a method for determining a physical property of an analyte ion is contemplated. That method comprises the following steps:

(a) obtaining a porous light-absorbing semiconductor substrate;

(b) introducing a quantity of an analyte having a physical property to be analyzed to said substrate to form an analyte-loaded substrate;

(d) irradiating the analyte-loaded substrate under reduced pressure to provide an ionized analyte; and (e) analyzing the ionized analyte for the physical property. Analysis of the analyte comprises one or more physical methods of analysis that are known to skilled workers , and are discussed above.

In a preferred embodiment, the determined physical property is mass, and an above contemplated method for determining a physical property of an analyte ion analyzes the mass to charge ratio (m/z) of the analyte ion by mass spectrometry techniques.

The present invention also relates to an apparatus for providing an ionized analyte for analysis. The apparatus has a porous substrate. The apparatus also has a source of radiation. When the source of radiation irradiates the substrate under reduced pressure and an analyte is adsorbed on the substrate, the irradiation can cause the desorption and ionization of the analyte for analysis.

In one embodiment of the invention the porous semiconductor substrate is bonded with a substance having a saturated carbon atom bonded to the substrate. A preferred embodiment of the invention has the substrate being bonded with ethyl phenyl groups.

Alternatively, in another embodiment of the invention, the analyte-loaded substrate is placed under reduced pressure before irradiation.

In still another embodiment of the invention, the porous semiconductor substrate is oxidized.

In yet another embodiment of the invention, the porous semiconductor substrate has a hydrophobic surface coating.

In a still further embodiment of the invention, the porous semiconductor substrate has a hydrophilic surface coating.

In a still another embodiment of the invention, the porous semiconductor substrate has a fluorophilic surface coating.

In yet another embodiment of the invention, the analyte-loaded substrate is irradiated with a laser.

In a still further embodiment of the invention, the analyte-loaded substrate is irradiated with ultraviolet light.

In a yet still further embodiment of the invention, the analyte-loaded substrate is irradiated with light having a wavelength of approximately 337 nm.

In yet another embodiment of the invention, a positive voltage is applied to the analyte-loaded substrate.

In a still further embodiment of the invention, a voltage of about 5,000 to about 30,000 volts is applied to the analyte-loaded substrate.

The present invention has several benefits and advantages.

One benefit of the present invention is the provision of a sensitive technique for desorption/ionization of biomolecules at the picomole (pmol $10^{-12}$ mole), femtomole (fmol, $10^{-15}$ mole) and attomole (attmol, or $10^{-18}$ mole) level. The present invention does so with little or no degradation or fragmentation, in contrast to what is typically observed with other direct desorption/ionization approaches.

An advantage of the present invention is that a contemplated method and apparatus work well on samples with concentrations of salts and buffers above 10 mM (millimolar). A contemplated method and apparatus can be 100-times more tolerant of salts than the MALDI or ESI desorption/ionization techniques, which is an important advantage in biomolecular and protein analysis.

Another benefit of the present invention is that a substrate for desorption/ionization of analytes is utilized that does not require the use of a matrix. Even without a matrix the present invention can directly desorb and ionize analytes with a m/z ratio value of up to at least 12,000.

Another advantage of the present invention is that the measurement of m/z values without a matrix, such as that present in MALDI, also makes a contemplated method and apparatus more amenable to small molecule analysis. In the absence of a matrix, a contemplated method and apparatus avoid the low-mass interference that a matrix normally offers. This low-mass interference is avoided in both direct mass spectrometry measurements and in post source decay measurements.

Yet another benefit of the present invention is that in addition to being capable of directly detecting analytes without a matrix, a contemplated process can be used with a matrix-bound analyte deposited on the substrate to detect analytes of molecular weights in excess of 12,000 Daltons. Aided by a matrix, the present invention exhibits less matrix interference than conventional matrix-assisted techniques. The reduced matrix interference improves the measured peak height of the measured analyte as compared to the broadened and shortened peaks seen in MALDI measurements.

Yet another advantage of the present invention is the ease of chemically, and structurally modifying the substrate to optimize the desorption/ionization characteristics of the substrate for biomolecular or other applications.

Yet another benefit of the present invention is the ease of substrate modification to permit the substrate to be modified to inhibit the spreading of solvents on the substrate. Inhibiting the spread of solvents on the substrate surface facilitates the confining of the sample (analyte) to a desired portion of the substrate. Confining the sample to a small portion of the substrate improves the concentration of sample at the point of illumination, and thereby improves sensitivity.

Still another advantage of the present invention is that the rapid deposition and analysis of a few picomoles or less of material and the ease of automation makes analysis of products of combinatorial chemistry an application for the present invention.

As a new desorption/ionization approach, the present invention offers excellent sensitivity, high tolerance of contaminants, does not require the use of a matrix. Also, the present invention presents reduced or no matrix interference. Moreover, because the surface properties of the porous silicon can be easily tailored, the present invention can provide improved analysis for biomolecular mass spectrometry applications.

Still further benefits and advantages of the invention will be apparent to the skilled worker from the discussion that follows.

BRIEF DESCRIPTION OF THE DRAWINGS

In the drawings forming a part of this disclosure:

FIG. 1(*b*) depicts a schematic of an operational configuration for the desorption/ionization studies using a laser pulse, a porous semiconductor substrate containing (or synonymously, loaded with) an analyte, crystalline silicon supporting the substrate, and analyte ionized and desorbed by a laser pulse travelling toward analysis apparatus (not shown);

FIG. 1(*c*) is an expanded view of the porous semiconductor substrate in FIG. 1(*b*) that depicts a chemically modified porous silicon surface with a schematic depicting the silicon atoms bonded to terminations, described further herein;

FIG. 2(*b*) depicts a DIOS mass spectrum, with axes as in FIG. 2(*a*), of a mixture of 1 pmol each of caffeine (m/z 196), an antiviral drug WIN (m/z 357), with the structure below,

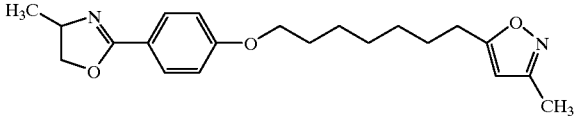

Figure 2A:
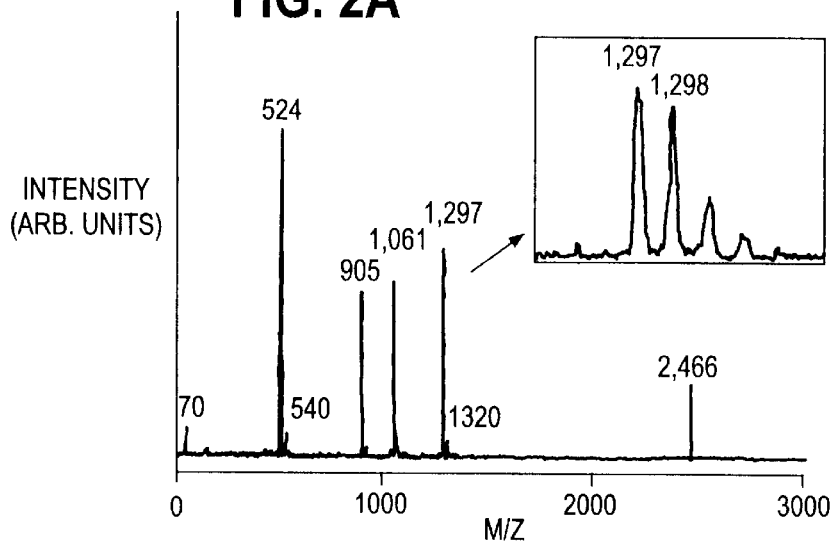
FIG. 2(*a*) depicts a DIOS mass spectrum of a mixture of 2 pmol each of five peptides, discussed in Example 10, including met-arg-phe-ala (MRFA)(m/z 524), des-arg-bradykinin (m/z 905), bradykinin (m/z 1061), angiotensin (m/z 1297), and ACTH (m/z 2466), the small peaks at m/z 540 and m/z 1320 are oxidized MRFA and sodium adduct of angiotensin, respectively, and the signal at m/z 70 (possibly $C_5H_{10}^+$) corresponding to a surface background ion, with the inset spectrum displaying an isotope pattern near m/z 1297, with the heights along the y-axis of the peaks representing the intensity of detected ions, given in arbitrary relative intensity units, and the x-axis representing the m/z to which the detected ions correspond.
Figure 2B:
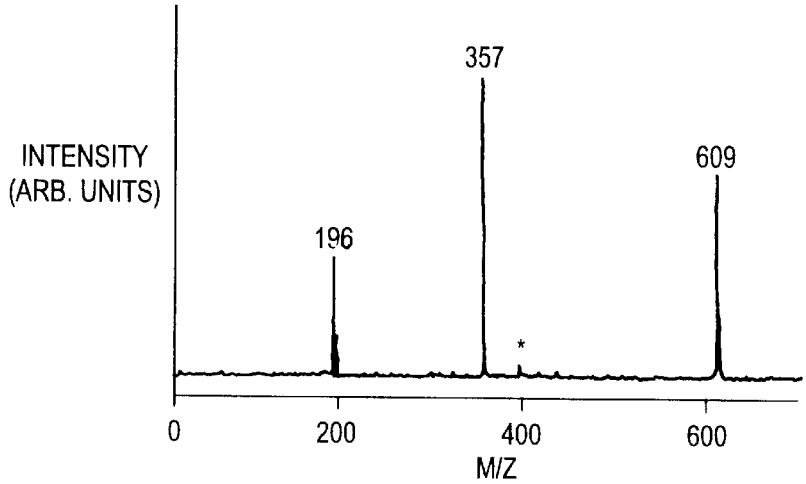
Figure 2C:
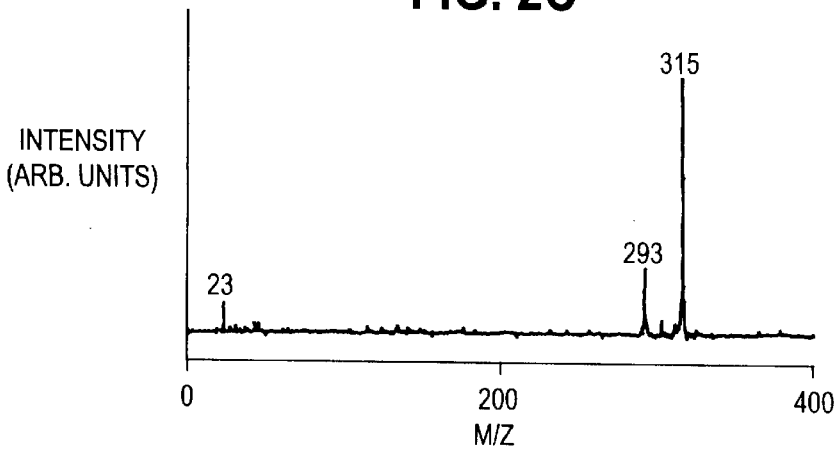
Figure 3A:
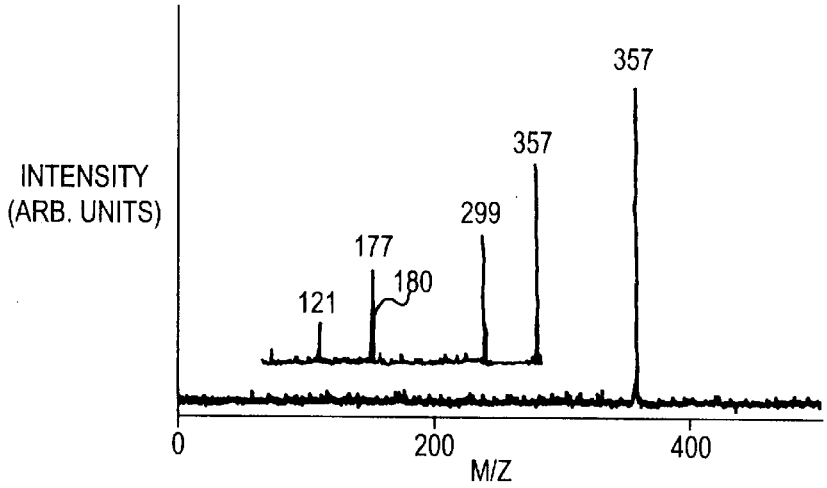
Figure 3B:
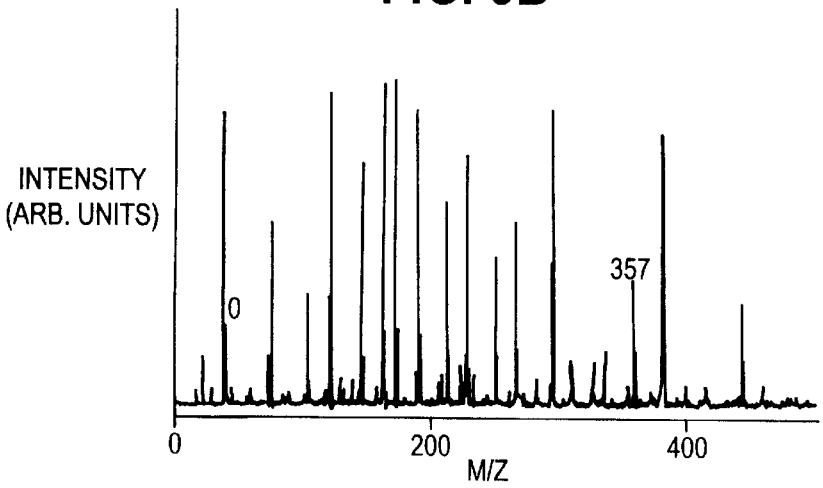
Figure 3C:
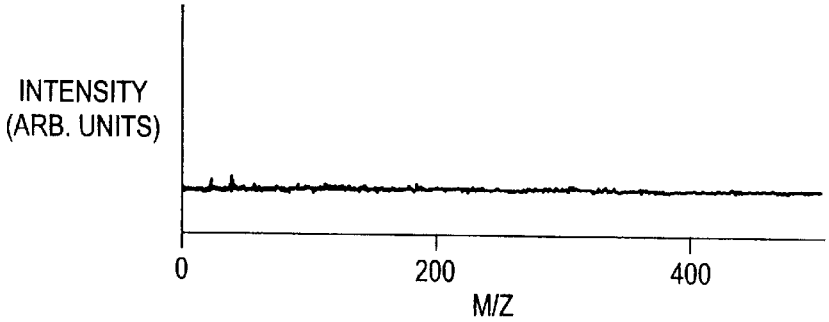
Figure 4A:
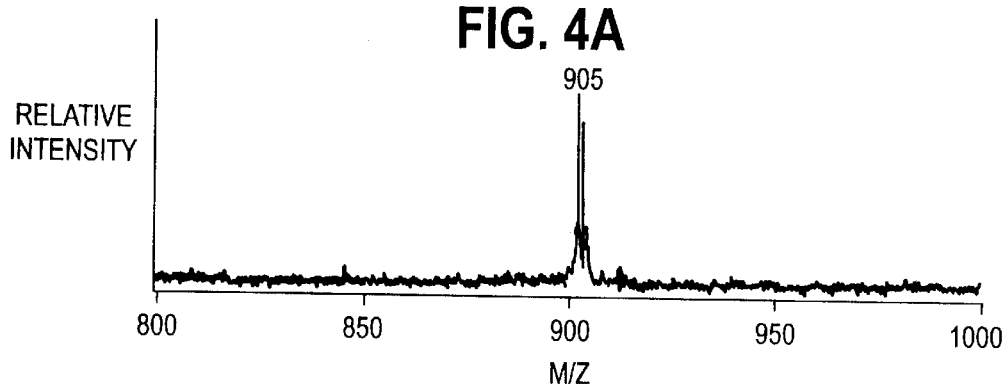
Figure 4B:
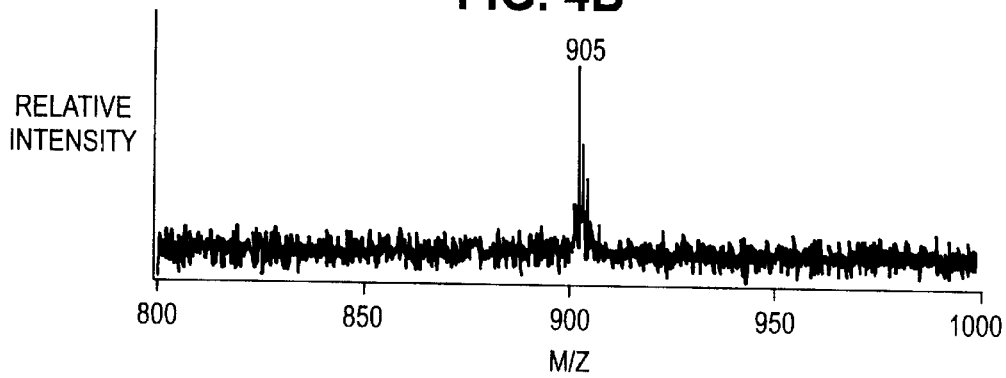
Figure 4C:
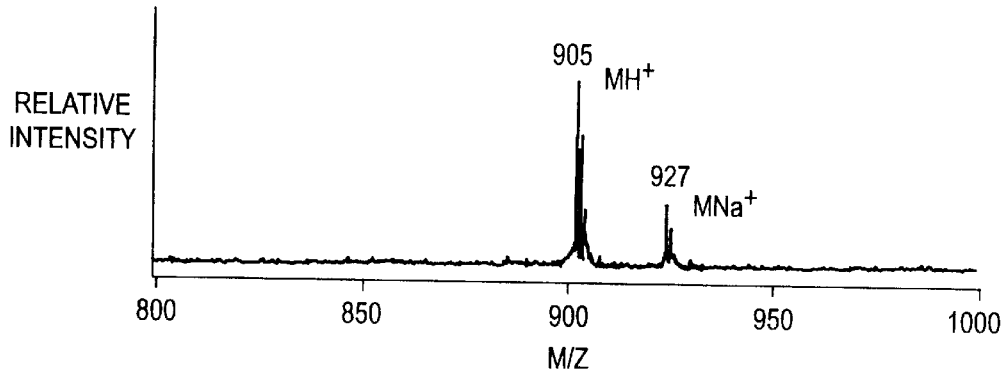
Figure 4D:
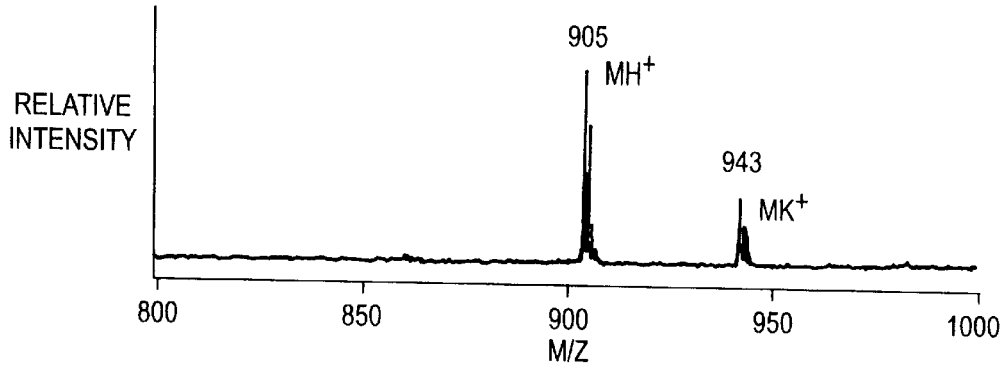

reserpine (m/z 609), and an impurity from the caffeine (*), discussed in Example 11;

FIG. 2(*c*) is the DIOS mass spectrum, with axes as in FIG. 2(*a*), of 10 pmol of N-octyl β-D-gluco-pyranoside (m/z 293)

and its sodium adduct (m/z 314), as well sodium ion (m/z 23), discussed in Example 12;

FIG. 3(*a*) depicts the mass spectrum, with axes as in FIG. 2(*a*), of 500 fmol of the WIN antiviral drug using DIOS with the inset spectrum depicting the result of DIOS-PSD mass spectroscopy measurements performed on the WIN drug using DIOS, $MH^+$ labeling the peak of the protonated WIN molecule at m/z 357, achieving a 10 part per million accuracy, and discussed in Example 13;

FIG. 3(*b*) depicts the mass spectrum, with axes as in FIG. 2(*a*), of 500 fmol of the WIN antiviral drug in a α-cyano-4-hydroxycinnamic acid (molecular weight 189) matrix using MALDI-MS, discussed in Example 13;

FIG. 3(*c*) depicts the mass spectrum, with axes as in FIG. 2(*a*), of 500 fmol of the WIN antiviral drug using laser desorption mass spectrometry (LDI-MS) off of a gold MALDI plate, discussed in Example 13;

FIG. 4(*a*) depicts a DIOS mass spectrum, with axes as in FIG. 2(*a*), of a 7 fmol des-arg-bradykinin sample, discussed in Example 14;

FIG. 4(*b*) depicts a DIOS mass spectrum, with axes as in FIG. 2(*a*), of a 700 attmol des-arg-bradykinin sample, discussed in Example 14;

FIG. 4(*c*) depicts a DIOS mass spectrum, with axes as in FIG. 2(*a*), of a 2 pmol sample of des-arg-bradykinin in the presence of 2 M NaCl, discussed in Example 15;

FIG. 4(*d*) depicts a DIOS mass spectrum, with axes as in FIG. 2(*a*), of a 2 pmol sample of des-arg-bradykinin in the presence of a saturated K3PO4 buffer solution, discussed in Example 15.

Figure 5A:
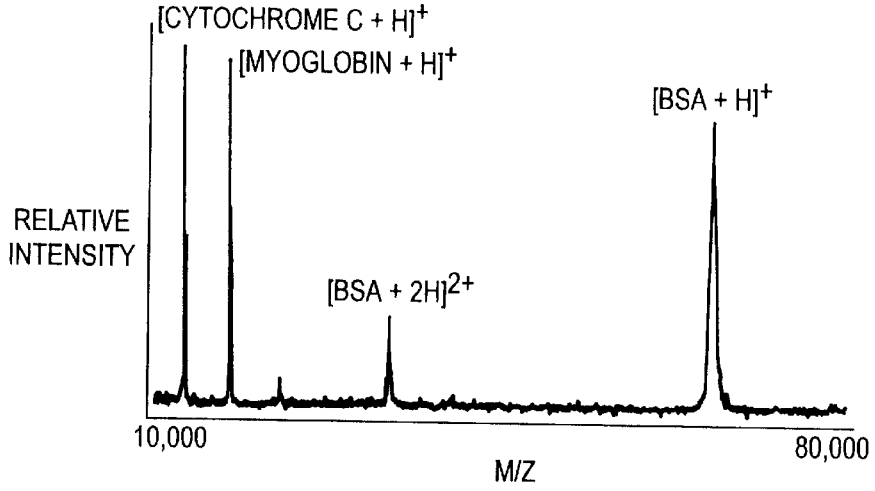
Figure 5B:
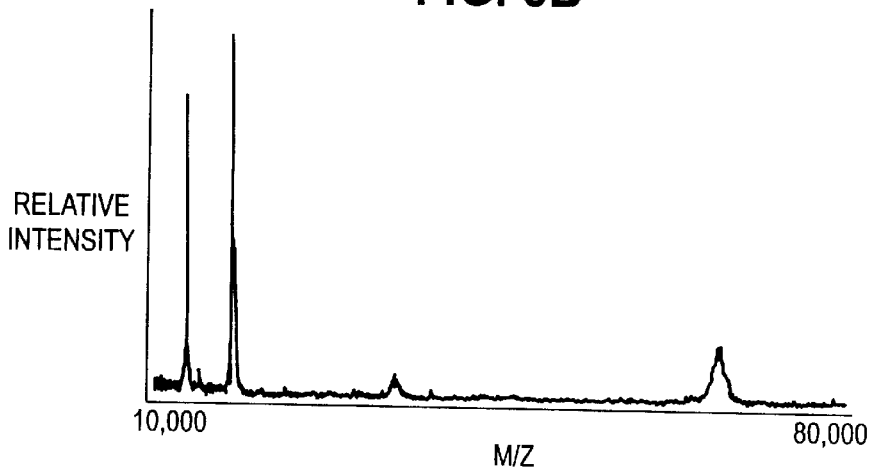
Figure 5C:
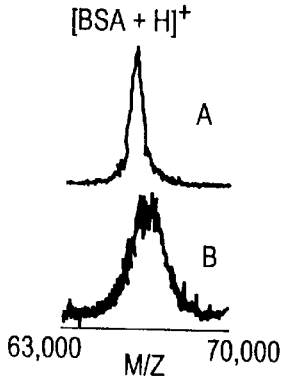

FIGS. 5(*a*) & (*b*) depict mass spectra, with axes as in FIG. 2(*a*), of a mixture of cytochrome C (m/z 11,700), myoglobin (m/z 17,200), and bovine serum albumin (BSA)(m/z 68000) using DIOS, FIG. 5(*a*), and MALDI, FIG. 5(*b*), the small peak at approximately m/z 30,000 is doubly ionized BSA, discussed in Example 16;

FIG. 5(*c*) depicts a comparison of the mass spectra, using axes as in FIG. 2(*a*), for BSA using DIOS (A) and MALDI (B) from FIGS. 5(*a*)&(*b*) respectively, depicting the improved resolution achieved with DIOS, and discussed in Example 16.

DETAILED DESCRIPTION OF THE INVENTION

Although the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Use of the present invention contemplates a method and an apparatus useful for ionizing an analyte for use in the assay of one or more physical properties such as mass spectrometry especially. First, the present invention will be illustrated in the context of desorption and ionization of an analyte for the purpose of mass spectrometry. The preparation of the porous, light-absorbing substrate is discussed.

THE OPERATION OF THE INVENTION IN PREFERRED EMBODIMENT OF MASS SPECTROMETRY

A preferred embodiment of the present invention contemplates an improved method for ionization of an analyte from a porous, light absorbing, semiconductor. The present invention also contemplates introducing the analyte typically in solution to facilitate detection of the analyte by physical methods, preferably mass spectrometry. Embodiments of the contemplated technique are described herein in terms of the preferred embodiment, a porous silicon surface. Accordingly, when using a porous silicon substrate, a contemplated method can be referred to in terms of the preferred porous silicon embodiment—Desorption/Ionization On Silicon (DIOS).

A contemplated method using DIOS to study the desorbed analyte with mass spectrometry can be referred to as DIOS-MS, and a contemplated method that performs post source decay measurements using DIOS can be referred to as DIOS-PSD-MS. Similarly, methods using MALDI as a starting point can be referred to as MALDI-MS.

The present invention contemplates loading an analyte onto a porous semiconductor substrate. Not wishing to be bound by theory, the analyte molecules can be trapped in or sorbed on the substrate. When the material is adsorbed onto the substrate, adsorption is the equivalent of loading, and desorption is equivalent to unloading. It is believed that most analytes are adsorbed onto the porous semiconductor substrate, and the embodiments of the invention discussed here are described accordingly. Nevertheless, a contemplated process and method include all variations where an analyte is loaded onto an appropriate substrate.

The porous semiconductor substrate absorbs electromagnetic radiation. Because of the absorptivity of the semiconductor substrate, the substrate acts as an energy receptacle for electromagnetic radiation. This absorbed electromagnetic energy is used to ionize the trapped analyte. The ionized analyte is then detected by mass spectrometry mass analyzing apparatus.

The preferred approach for this new desorption/ionization strategy for mass spectrometry uses a pulsed laser desorption/ionization from a porous silicon substrate. As made known by Amato et al in *Optoelectronic Properties of Semiconductors and Superlattices* (eds. Amato, G., Delerue, C. & Bardeleben, H.-J.v.) 3–52 (Gordon and Breach, Amsterdam, 1997), porous silicon surfaces in particular are strong absorbers of ultraviolet radiation. The preparation and photoluminescent nature of such porous silicon surfaces is described by Canham, *Appl. Phys. Lett.* 57, 1046 (1990) and recently reviewed by Cullis et al, *Appl. Phys. Lett.* 82, 909, 911–912 (1997) to provide a succinct review of later research on porous silicon. Cullis et al, also describe and review other photoluminescent porous semiconductors suitable for the approach described herein that exhibit the necessary strong absorption, including SiC, GaP, $Si_{1-x}Ge_x$, Ge, and GaAs, and also InP that exhibits weak photoluminescence.

Other semiconductors that exhibit strong UV absorption when prepared with a porous surface are within the scope of this invention including not only Group IV semiconductors (for example diamond, and α-San), but also Group I-VII semiconductors (for example CuF, CuCl, CuBr, CuI, AgBr, and AgI), Group II-VI semiconductors (for example BeO, BeS, BeSe, BeTe, BePo, MgTe, ZnO, ZnS, ZnSe, ZnTe, ZnPo, CdS, CdSe, CdTe, CdPo, HgS, HgSe, and HgTe), Group III-V semiconductors (for example BN, BP, BAs, AlN, AlP, AlAs, AlSb, GaN, GaP, GaSb, InN, InAs, InSb), Sphaelerite Structure Semiconductors (for example MnS, MnSe, β-SiC, $Ga_2Te_3$, $In_2Te_3$, $MgGeP_2$, $ZnSnP_2$, and $ZnSnAs_2$), Wurtzite Structure Compounds (for example NaS, MnSe, SiC, MnTe, $Al_2S_3$, and $Al_2Se_3$), I-II-$VI_2$ semiconductors (for example $CuAlS_2$, $CuAlSe_2$, $CuAlTe_2$, $CuGaS_2$, $CuGaSe_2$,$CuGaTe_2$, $CuInS_2$, $CuInSe_2$, $CuInTe_2$, $CuTlS_2$, $CuTlSe_2$, $CuFeS_2$, $CuFeSe_2$, $CuLaS_2$, $AgAS_2$, $AgAlSe_2$, $AgAlTe_2$, $AgGaS_2$, $AgGaSe_2$, $AgGaTe_2$, $AgInS_2$, $AgInSe_2$, $AgInTe_2$, $AgFeS_2$) as well. Other conducting or semiconducting materials, such as metals and semimetals, which absorb light and are capable of transmitting the light energy to an analyte to ionize it are within the scope of the invention as well. In addition, other well known substrates, such as $Al_2O_3$, which are capable of absorbing radiation, embody this invention when they absorb light and transmit it to an analyte to ionize the analyte.

Figure 1A:
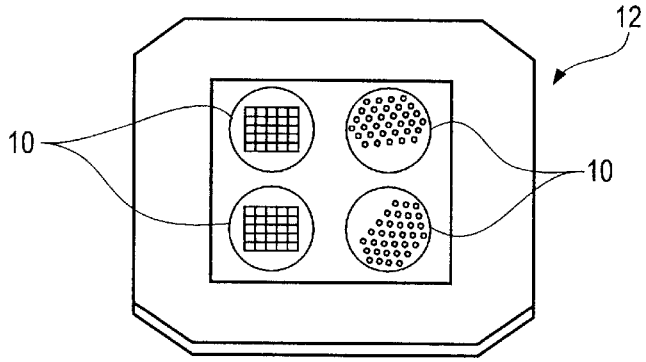
FIG. 1(*a*) depicts a DIOS (desorption/ionization on silicon) plate, which is a MALDI plate that has been modified to hold four pieces of porous semiconductor substrate.
Figure 1B:
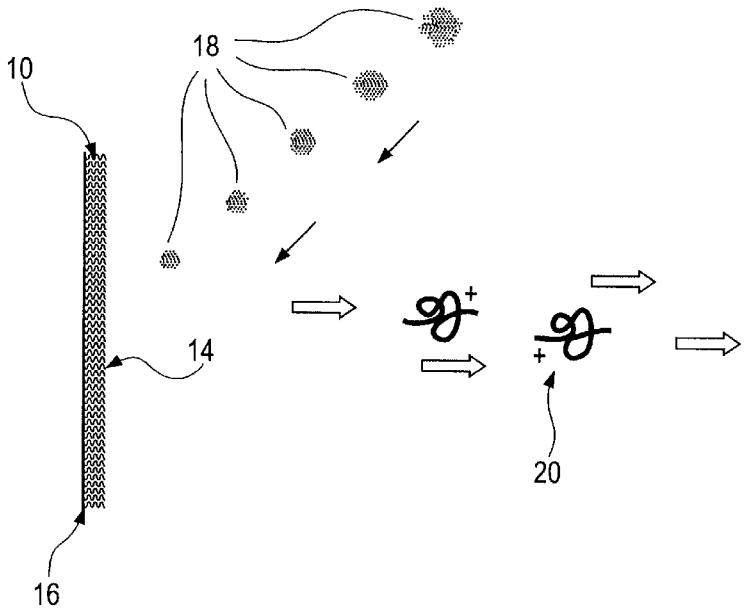
Figure 1C:
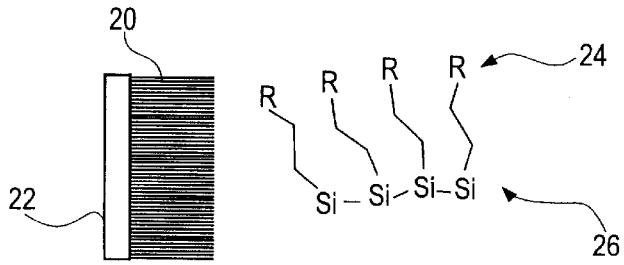

FIGS. 1(*a*)–(*c*) depict a schematic of an arrangement for carrying out a contemplated method in ionizing and desorbing an analyte for use in the preferred embodiment of mass spectrometry. FIG. 1(*a*) depicts four porous silicon substrates 10 mounted to a plate 12 of the type customarily used in MALDI studies. The plate 12 depicted in FIG. 1(*a*) can have an analyte (not shown) introduced. The introduced analyte 14 is loaded on the porous silicon substrate 10. The plate 12 is placed in a commercial MALDI mass spectrometer to perform mass spectrometry. Variations on this setup will be apparent to skilled workers, and are within the scope of the present invention.

FIG. 1(*b*) illustrates a reaction schematic showing the operation of a contemplated method in the preferred embodiment of a porous silicon substrate 10 supported on crystalline silicon 16, illuminated by a series of laser pulses 18. The porous silicon substrate 10 absorbs the laser pulses 18 and ionizes and unloads the analyte 14 to form a desorbed and ionized analyte 20. The desorbed and ionized analyte 20 then travels to mass analysis apparatus (not shown).

FIG. 1(*c*) depicts an enlarged, cross-section view of the porous silicon substrate. The porous region 20 shown has a plurality of pores etched in the crystalline silicon 22. A chemically modified, terminated, or coated silicon surface can have R groups 24, (discussed hereinafter) bonded to the silicon in the porous region 26.

Overview of the Substrate

As outlined above, if one has a suitable plate with the analyte already loaded on the substrate, the DIOS technique can be practiced in a straightforward manner. First, the physical nature of porous silicon is described to permit skilled workers to understand the physical properties desired in a preferred embodiment of the invention. Then, the preparation of porous silicon from bulk silicon is described to permit skilled workers to prepare such substrates.

The preparation of a porous semiconductor substrate includes: (1) preparing a porous substrate from a solid substrate, often a semiconductor wafer, including the preferred embodiment of selectively preparing portions of a solid substrate as a porous substrate; and, in preferred situations, (2) modifying the substrate with optional substrate terminations (synonymous with "coatings", "ligands", "modifications", or "monolayers") for the porous substrate.

A preferred embodiment of the invention, embodied in the DIOS process, utilizes a porous silicon substrate prepared from flat crystalline silicon. The porous silicon substrate can be prepared using a simple galvanostatic etching procedure as summarized by Cullis, et al, *J. Appl. Phys.* 82, 909 (1997) and detailed by Jung, et al *J. Electrochem. Soc.* 140, 3046 (1993) and also detailed in Properties of Porous Silicon (Canham ed., Institution of Electrical Engineers 1997). Undoped semiconductors can be prepared using light etching or simple chemical etching as is known to those skilled in the art. Jung, et al, *J. Electrochem. Soc.* 140, p.3046–64 (1993). The simplest method is to maintain a semiconductor in contact with HF/HNO3. Id. A solution of $HF:HNO_3:H_2O$ of 1:3:5 for 120 seconds in contact with a silicon substrate can render silicon photoluminescent.

The result of the galvanostatic etching procedure, porous silicon, as described by Sailor, et al, *Adv. Mater.* 9, 783 (1997) and Canham, *Appl. Phys. Lett.* 57, 1046 (1990), is a microns-thick porous layer with a nanocrystalline architecture that often exhibits bright photoluminescence upon exposure to UV light. Photoluminescence of the supporting porous semiconductor is not required for practice of the invention. Although the subject invention and process utilizes a porous semiconductor surface that absorbs electromagnetic energy, the present invention can utilize porous silicon surfaces that fail to radiate light after such absorption.

Preferably, the porous silicon surface can be modified with a termination (otherwise referred to as a coating, modification, or monolayer). Modifying the porous surface with a termination can improve the stability of the surface, improve the signal generated by the surface is mass spectroscopy experiments, and improve control of the introduction (or loading) of the analyte to the substrate. Further, the porous silicon surface can also be modified through derivatization with receptors to assist the identification of ligands. O'Donnell, et al, *Analytical Chemistry* 69, 2438–2443 (1997).

Modifying the surface via hydrosilylation can radically improve the stability of the porous silicon substrates. Hydrosilylation with organic terminations yields hydrophobic porous silicon that is stable with respect to aqueous media. Such substrates can be reused repeatedly with little degradation. For example, substrates that are normally destroyed by strongly alkaline solutions can be boiled in them after being functionalized by the Lewis acid-mediated or light-promoted hydrosilylation techniques as demonstrated by Buriak et al, *J. Am. Chem. Soc.* 1998, 120, 1339–1340, and Stewart, et al, *Angew. Chem.* Int. Ed. 37, 3257–3261 (1998).

A benefit of the use of porous silicon as the substrate is the ease of making modifications that inhibit the spreading of solvents thereon, which in turn facilitates the confining of the analyte-containing sample to a desired portion of the surface. Confining the sample to a small portion of the substrate increases the concentration of sample at the point of illumination, and thereby improves sensitivity.

Preferably, the solution does not spread widely on the substrate so that the analyte remains loaded on a small portion of the substrate. As detailed herein, porous silicon substrates can be made with hydrophobic, hydrophilic, or fluorophilic surfaces. The restriction of the spread of solution can be achieved by making the entire substrate impede spreading, or have defined regions where the solvent spreads confined by regions where the solvent does not spread A number of practical considerations favor the use of porous silicon over other materials. No silicon-containing adducts have been observed in DIOS-MS (desorption/ionization on silicon-mass spectroscopy) spectra that interfere with analyses, indicating that porous silicon substrates are inert to the analysis conditions. Porous silicon material production is inexpensive and simple (the material cost of five 1.0 $cm^2$ plates is about one dollar (US)).

As reported by Cullis, et al, *J. Appl. Phys.* 82, 909–965 (1997), porous silicon can be easily integrated with existing silicon-based technology, permitting, for example, its application into miniaturized chip, microfluidic chemical reactors that are lithographically etched into crystalline silicon wafers. See Freemantle, C&EN News, pp. 27–36, Feb. 22, 1999 (describing the state of theicrofluidic art). For instance, porous silicon features as small as 20 $\mu$m and 100 nm can be produced through standard optical techniques as reported by Doan, et al *Appl. Phys. Lett.* 60, 619–620 (1992), and ion implantation, as reported by Schmuki, et al, *Phys. Rev. Lett.* 80, 4060–4063 (1998), respectively.

Additionally, porous silicon is also a highly studied material, and has been the subject of over 1500 scientific articles. Cullis, et al, *J. Appl. Phys.* 82, 909, 910 (1997).

Porous Silicon Defined by Porosity Properties

The porosity of the porous silicon can be defined as the amount of silicon lost from the native state of bulk silicon due to anodization and etching. This gravimetric measure can be done by calculating an average density for the porous semiconductor layer and comparing that density to that of the original semiconductor. Porosity (expressed as a percentage)=10–100* (density of porous semiconductor layer/density of original semiconductor layer). Accordingly, a sample of porous semiconductor with a porosity of 45% is 45% void (empty), and 55% semiconductor (filled).

The details of gravimetric procedure can be found in Brumhead, et al, *Electrochim. Acta* (UK) p. 191–97, vol. 38 no 2/3 (1993). In the case of porous silicon, porosities of substantially zero % to substantially 100% (i.e., greater than 95%) according to Canham (The Institution of Electrical Engineers, London, 1997) can be prepared. Porous silicon is "porous", that is suitable for the practice of the present invention, when the porous silicon has a porosity of approximately 4% to substantially 100%. Porous silicon with porosities of 50%–80% is preferred and porosities of 60–70% are most preferred.

Another way of defining what silicon can be considered "porous" is by the specific surface area per mass or volume. The specific surface area can be expressed as either as a surface area per unit mass of porous semiconductor, or as a surface area per unit volume of the porous semiconductor, the two numbers being related by the density of the semiconductor material.

Any deviation from a perfectly solid semiconductor wafer results in some increase in the surface area beyond that of a simple geometric surface observed macroscopically. For the purposes of the present invention, the specific surface area of porous silicon is typically approximately 1 meter squared per gram of porous silicon (or approximately 2 meters squared per cubic centimeter of porous silicon), to approximately 1000 meters squared per gram ($m^2/g$) of porous silicon (or approximately 2300 meters squared per cubic centimeter of porous silicon ($m^2/cm^3$). Canham, in Properties of Porous Silicon, pp. 83–88 (The Institution of Electrical Engineers, London, 1997). Porous silicon surfaces with specific surface areas of 200 to 800 $m^2/g$ (450 to 1900 $m^2/cm^3$) are preferred. Surface areas of approximately 640 meters squared per gram of porous silicon (or approximately 1500 meters squared per cubic centimeter) are readily achieved and more preferred.

The specific surface area can be measured by BET gas adsorption isotherms. Herino, in *Properties of Porous Silicon*, pp. 89–96, (The Institution of Electrical Engineers, London, 1997); Herino, et al, *J. Electrochem. Soc.* 134, p.1994–2000 (1987). Other methods for measuring the specific surface area include IR absorbance measurements, George, et al, *Mater. Res. Soc. Symp. Proc.* vol. 298, p. 289–94 (1993), measuring the etch rate of the porous silicon in HF, Halimaoui, *Surf. Sci. Lett.* vol 306, p.L550–54 (1994), and measuring interfacial capacitance, Peter, et al, *Appl. Phys. Lett.* vol 66, no. 18 p. 2355–57 (1995).

A sample of porous silicon can also be characterized by the size of the pores in accordance with IUPAC guidelines as per Rouquerol, et al, Pure Appl. Chem. 66, 1739 (1994). As Cullis, et al note, J. Appl. Phys. 82, 909, 911 (1997), not all researchers in the field of porous silicon use terms consistent with the IUPAC terminology, as is done here. Therefore, care is required in reading the literature in this area.

A porous semiconductor such as silicon is an effective substrate for a contemplated method and process regardless of whether the porous silicon is microporous, macroporous, or mesoporous. Mesoporous substrates are those having a dominant pore size of less than 2 nm (nanometers). Mesoporous substrates are those having a dominant pore size of 2–50 nm. And macroporous substrates are those having a pore size of greater than 50 nm. The size of the pores in porous silicon can be observed by scanning electron microscopy (SEM) or transmission electron microscopy (TEM). Generally, substrates with smaller pore sizes provide a more intense ion signal with a contemplated method.

The Process of Preparing Porous Silicon

Effective porous silicon samples for DIOS, as defined above, can be prepared from either n-type or p-type silicon. The thickness, morphology, porosity, resistivity and other characteristics of the material can be modulated through choices of silicon wafer precursor and etching conditions known to those skilled in the art. A variety of etching conditions were utilized to produce microporous (<2 nm pore sizes) as per Canham in *Properties of Porous Silicon*, p.83–88 (Canham, ed. The Institution of Electrical Engineers, London, 1997) and mesoporous (2–50 nm pore sizes) porous silicon, as described by Herino, in Properties of Porous Silicon, p.89–96 (Canham, ed. The Institution of Electrical Engineers, London, 1997). Both n-type mesoporous samples and p-type microporous or mesoporous samples were effective in generating useful ion signals.

To prepare porous silicon from n-type silicon, P-doped, (100) orientation, 0.65 Ω.cm resistivity Si wafers that served as the anode were placed in ohmic contact with an aluminum tongue. The wafers were then etched for 1–3 minutes at room temperature in a single electrochemical cell using a +71 $mA/cm^2$ current density in a 1:1 solution of EtOH/49% HF(aq) which is in contact with a platinum cathode located 1–2 mm above the silicon surface. During the etching, the wafers were illuminated by a 300 W tungsten filament bulb to provide a light intensity of at least 22.4 mW/cm2 incident on the silicon. A wide range of conditions can provide surfaces active for DIOS. As will be apparent to skilled workers, current density, light intensity, electrolyte concentration, and temperature can all be varied to produce porous silicon. All such variations are within the scope of the present invention.

Using the method of Doan, et al, *Appl. Phys. Lett.* 60, 619–620 (1992), a porous silicon substrate can be etched with patterned light in order to create a wafer where only part of the semiconductor is etched and anodized. This use of patterned light, or photopatterning, can select where the galvanostatic etching just described for n-type silicon occurs on the wafer.

Using photopatterning, one can galvanostatically etch an array of well plates on n-type silicon, permitting for the analysis of analyte-containing samples in each of the well plates. Studies can be set up to analyze each of the well plates in a predetermined order. Surface photopatterning can also be used to identify where on an otherwise uniform porous silicon surface the sample has been placed. The placement of sample in known locations can be used to automate multiple DIOS measurements from a single plate as is commonly done in conjunction with MALDI studies.

In a preferred embodiment of the invention, an array of porous silicon zones (or wells or well plates) is photopatterned on a silicon wafer. Each of the well plates so made constitute a separate porous semiconductor substrate. To photopattern porous n-type silicon, the light from the 300 W tungsten filament lamp shines through a mask and an f/50 reducing lens to permit the formation of porous silicon in the illuminated areas. Both 5×5 and 5×6 arrays of 500 micron spots have been galvanostatically etched into 1.1 $cm^2$ wafers to permit the analysis of 25 or 30 samples in a predetermined order.

Variations of spots size, wafer size, and the resulting number of samples that can be prepared will be apparent to skilled workers. The application of photopatterned porous silicon is facilitated even further by the fact that most existing MALDI mass spectrometers can analyze an array of samples in series. These existing MALDI mass spectrometers can be used to perform the analysis of an array of DIOS samples in series simply by inserting porous silicon well arrays as modifications to a MALDI sample plate.

Alternatively, to prepare unpatterned porous silicon from p-type silicon, B-doped, (100) orientation, 0.01 Ω.cm resistivity Si wafers can be etched in a way similar to n-type silicon at 37 $mA/cm^2$ current density in the dark for 3 h in a 1:1 solution of EtOH/49% HF (aq). Again, a wide range of other conditions can also provide surfaces active for DIOS. In particular, a wide variety of current densities produce porous silicon. As will be apparent to skilled workers, current density, light intensity, electrolyte concentration, and temperature can all be varied to produce porous silicon. All such variations are within the scope of the present invention.

For both n-type and p-type porous silicon, after anodization the wafers, were washed with ethanol and blown dry under a nitrogen stream. Such wafers are then suitable for practicing a contemplated method as they are, or preferably, can be chemically modified to coat the porous silicon with different terminating functional groups to make the porous silicon more suitable to particular needs.

Introduction To Modified Porous Silicon Substrates

Yet another advantage of the present invention is the ease of chemically, and structurally, modifying the substrate to optimize the desorption/ionization characteristics of the substrate for biomolecular or other applications. Preferably, the solution can not spread widely on the substrate so that the analyte remains on a small portion of the substrate. Although porous silicon substrates can be prepared for use with the subject invention having hydrophobic, hydrophilic, or fluorophilic surfaces, the preparation of hydrophobic surfaces is preferred for biomolecular analysis.

One method of improving the substrate involves restricting the spread of solution by making the entire substrate impede spreading, or have defined regions where the solvent spreads, confined by regions where the solvent does not spread. Confining the sample to a small portion of the substrate improves the concentration of sample at the point of illumination, and thereby improves sensitivity.

The DIOS approach of the subject invention was investigated on four porous silicon substrates, each containing different surface terminations. Such terminations investigated include: hydrogen (the native state of the porous silicon after the preparation of porous silicon given above), dodecyl ($—(CH_2)_{11}CH_3$), ethyl phenyl ($—CH_2CH_2C_6H_5$), and oxide. Such surface terminations attached to the porous silicon with a saturated carbon atom bonded to the silicon are preferred. The more hydrophobic surfaces, and in particular an ethyl phenyl terminated surface, typically provided better results for the same quantity of analyte from an aqueous medium than did the native porous silicon.

Freshly etched porous silicon substrates, just described, are hydrophobic due to a metastable, silicon-hydride termination, which is a saturated bond. The metastable silicon-hydride termination is inherently unstable in the presence of oxygen and can eventually oxidize in air to a silicon-oxide surface, which also bonds to the silicon with a saturated bond. The substrate can also be quickly chemically oxidized to produce a high quality oxide surface.

The silicon-hydride termination can also be changed through Lewis acid-mediated or light-promoted hydrosilylation reactions. These and other hydrosilylation reactions stabilize and functionalize porous silicon substrates. The coatings added via these hydrosilylation reactions generally serve to render the surface hydrophobic, but can be hydrophilic when the terminations exhibit chemically appropriate substituents.

Because of the high stability of the hydrophobic, hydrosilylated substrates to aqueous media, such substrates can be reused repeatedly with little degradation. For example, substrates that are normally destroyed by strongly alkaline solutions can be boiled in them after being functionalized by the Lewis acid-mediated or light-promoted hydrosilylation techniques as demonstrated by Buriak et al, *J. Am. Chem. Soc.* 1998, 120, 1339–1340, and Stewart, et al, *Angew. Chem. Int.* Ed. 37, 3257–3261 (1998).

Preparation of Modified Porous Silicon Substrates

The simplest modification of the porous silicon surface is to oxidize the hydrogen terminated surface created by the etching process. Oxidizing the porous silicon renders the porous silicon hydrophilic. The native porous silicon can be oxidized slowly by leaving the substrate exposed to air. Rapid oxidation of the substrate is preferred because the substrate can reach a final state of oxidation more quickly, and can provide more consistent results.

Porous silicon can be oxidized by placing the substrate in contact with an aqueous potassium hydroxide solution with a pH value of 12 under the illumination of a 300 W tungsten filament light bulb.

The native porous silicon can also be oxidized by placing it in either a 49 weight percent aqueous hydrogen peroxide solution, or a 20 weight percent nitric acid solution, and maintaining the silicon in contact with the oxidant for 30 minutes as per Nakajima, et al, *Appl. Phys. Lett.* 61, 46 (1992). Porous silicon can also be oxidized at high temperature in conventional rapid thermal oxidation (RTO) apparatus as reported by Petrova-Koch, et al, *Appl. Phys. Lett.* 61, 943 (1992). Temperatures from 700° C. to 1200° C. for 30 seconds give good results with ramping rates of 200° C./s on heating and 80° C./s on cooling.

Porous silicon can also be efficiently functionalized through a Lewis Acid mediated process as described by Buriak et al, *J. Am. Chem. Soc.* 1998, 120, 1339–1340.

An alkyne of the form RC≡CR' or an olefin of the form RR'C═R"R'" can be attached to the porous silicon surface. The four R groups in an alkene or the 2 in an alkyne, may be independently or not, hydrogen or optionally substituted alkyl, aryl or heteroaryl, or when the R groups are substituted may include substituents from the group consisting of ($C_1$–$C_2$4) alkoxy, hydroxy, halo, cyano, ester, a primary or secondary or tertiary amino, carbamido, thiol, alkylthio, ferrocenyl, or other electron donor or acceptor, or a biologically significant ligand selected from antibody, a receptor protein, DNA or RNA, or a DNA or RNA analog capable of forming a double stranded complex with DNA or RNA, or if two R groups and together with the carbon atoms to which they are attached form a 5 or 6 membered ring.

Porous silicon has been hydosilylated with the alkyne where R is hydrogen, and R' is: $—(CH_2)_9CH_3$ (from 1-dodecyne), $—(CH2)_8COOCH_3$ (from methyl 10-undcynoate), -phenyl (from phenylacetylene), -tert butyl (from tert-butylacetylene), —$(CH_2)_3CN$ (from 5-cyano-1-pentyne), and —$(CH_2)_2OH$ (from 3-butyn-1-ol). Porous silicon has been hydrosilylated with an olefin where R''' R'' and R'' are hydrogen, and R was $(CH2)_5CH_3$ (from 1-hexene). Porous silicon has also been hydrosilylated with an olefin where R, R', and R'' are all methyl groups and R''' is hydrogen (from 2-methyl-2-butene). Buriak, et al, *J. Am. Chem. Soc.* 1998, 120, 1339–1340. The hydrosilylated porous silicon with the methyl ester terminated R group was mildly hydrophilic, and the porous silicon modified with the hydroxy terminated alkyl group, and the nitrile terminated alkyl group were both strongly hydrophilic. The other terminations were hydrophobic.

The alkyne attaches as an olefin in an anti-Markovnikov addition with the porous silicon covalently bonded to one side of the new double bond and a hydrogen bonded on the other side to form a new cis double bond. In the case of the olefin, the carbon bearing the hydrogen covalently bonds to the porous silicon surface and the other end of the double bond gains a hydrogen. The result of reacting the porous silicon with an olefin is the formation of a coated substrate having silicon bonded to a saturated carbon atom, whereas reaction of porous silicon with an alkyne forms a coated substrate having silicon bonded to an unsaturated carbon atom.

The Lewis acid-mediated approach achieves hydrosilylation of olefins and alkynes under a wide variety of reaction conditions by using ethyl aluminum dichloride or similar Lewis acid. A porous silicon substrate can be easily functionalized under nitrogen by applying a 1M solution of ethyl aluminum dichloride in hexanes (25,161-5 or 25,692-7 from Aldrich P.O. Box 2060 Milwaukee, Wis. 53201) to the surface of the substrate and then admixing an alkyne or olefin to the solution on the surface of the substrate. In the case of the addition of some alkynes, the quantity of alkyne applied should be in excess of one molar equivalent of the ethyl aluminum dichloride or the hydrosilylation reaction can not proceed well owing to coordination of the Lewis acid to electron donating groups in the alkyne.

Porous silicon can also be efficiently functionalized through a light-promoted process as described by Stewart, et al, *Angew. Chem. Int.* Ed. 37, 3257–3261 (1998). Porous silicon can be functionalized by olefins and alkynes of the form RR'C═R''R''' and RC≡CR' by adding the neat olefin or alkyne to the surface of the porous silicon under an inert atmosphere, such as nitrogen, and then illuminating the combination with a tungsten white light source, as above, for as little as 15 minutes or more than 12 hours depending on how much the olefin or alkyne hinders nucleophilic attack.

An etched wafer can be placed in a TEFLON reaction cell which clamps onto the wafer and has a 1 ml (milliliter) reservoir above the wafer in which reactants can be placed. A reactant, neat olefin or alkyne, can be introduced to the porous silicon substrate under inert atmosphere. The reaction cell can then be sealed by clamping a borosilicate glass window over the reaction cell to seal the reservoir from air. The porous silicon substrate and the reactant can then be illuminated through the window, at an intensity of at least 22.4 $mW/cm^2$ at the substrate.

The 4 R groups in an alkene or the 2 in an alkyne, may be independently or not, hydrogen or optionally substituted alkyl, aryl or heteroaryl, or when the R groups are substituted may include substituents from the group consisting of ($C_1$–$C_{24}$) alkoxy, hydroxy, halo, cyano, ester, a primary or secondary or tertiary amino, carbamido, thiol, alkylthio, ferrocenyl, or other electron donor or acceptor, or a biologically significant ligand selected from antibody, a receptor protein, DNA or RNA, or a DNA or RNA analog capable of forming a double stranded complex with DNA or RNA, or if two R groups and together with the carbon atoms to which they are attached form a 5 or 6 membered ring. As with the Lewis acid-mediated process, the result is the formation of a coated substrate having silicon bonded to a saturated carbon atom, whereas reaction of porous silicon with an alkyne forms a coated substrate having silicon bonded to an unsaturated carbon atom.

The light activated process has been used with alkyne where R was —$(CH_2)_{10}CH_3$ (from 1-dodecyne) to produce a porous silicon surface with an —CH═CH—$(CH_2)_{10}CH_3$ termination. The light activated process has been used with olefins where R was —$(CH_2)_{10}CH_3$ (from 1-dodecene), -phenyl (from styrene), -methyl (from 2-methyl-2-butene), and —$(CF_2)_7CF_3$ perflorinated hydrocarbon. The resultant terminated porous silicon substrates were hydrophilic except for the perflorinated hydrocarbon surface which was fluorophilic.

An additional benefit of the light promoted process is that part of the porous silicon can be functionalized by masking part of the surface from illumination, leaving that remaining surface to be modified later, or to remain unmodified.

Once the silicon surface has been modified to be hydrophilic, hydrophobic, or fluorophilic, as appropriate for the intended end use, it is ready to have the analyte introduced.

Introducing the Analyte To Form An Analyte-Loaded Substrate

Once a suitable substrate has been prepared, a sample containing an analyte, with or without additional material, can be prepared to introduce (or synonymously deposit or load) analyte. Any method that permits an analyte to reach the pores of the substrate can be used. Such methods include not only the preferred delivery via an aliquot of solution, but can also include direct mechanical insertion of the solid, evaporation or sublimation of the analyte onto the substrate. Such introduction can have results including physical contact with the substrate, adsorption, and adsorbtion. Introducing an analyte, by whatever means, to a substrate yields an analyte-loaded substrate. Analytes are preferably introduced via solutions prepared to load approximately 500 attomoles for smaller samples or 100 picomoles for larger samples, although appropriate quantities of analyte in a sample for a particular application will be apparent to skilled workers.

For hydrophobic preparations of substrates, such as the native state of porous silicon or porous silicon with a hydrocarbon coating, which have been rendered hydrophobic, suitable analytes can be dissolved in deionized water and methanol, mixed in an appropriate proportion for the analyte, in concentrations of about 0.001 to 100.0 micromoles per liter. An 0.5–1.0 microliter sample of such a solution can then deposit from 500 attomoles to 100 picomoles of analyte. This is the preferred approach for bioanalytical studies where the analytes are normally soluble in hydrophilic solutions. As described earlier, the substrate can also be made fluorophilic with a termination that presents perfluorinated functionalities, and thereby rendered non-spreading to both hydrophobic and hydrophilic solutions. Preferably, the solution is permitted to dry before further preparation or study.

A benefit of the present invention is that it presents a substrate for desorption/ionization of analytes that does not require the use of a matrix, and can directly desorb and ionize analytes up to at least 12,000 m/z (mass to charge ratio of the detected ion expressed as atomic mass units (Daltons) per unit of elementary charge).

Alternatively, DIOS can be performed by introducing the analyte in a matrix-assisted manner. In comparison to MALDI on a conventional metal substrate, matrix-assisted DIOS provides similar sensitivity yet can yield significantly better resolution for proteins. For example, the resolution of bovine serum albumin (BSA) was over three times higher than that of MALDI analysis for the same sample. As depicted in FIG. 5, matrix-assisted DIOS for BSA had a significantly lower m/z and higher resolution observed than with conventional MALDI.

Preferably, after the deposited (or loaded or introduced) sample has been permitted to dry, the preparation of the sample can be improved by redissolving the sample. Redissolving the sample in methanol/$H_2O$ at a 1:1 v/v ratio provided a stronger signal, indicating that analyte penetration into the porous silicon can be important. Normally, an application of 0.5 microliters of methanol/water, at a 1:2 v/v ratio, to a sample first deposited as described above, provided a much stronger signal than samples that had not been redissolved.

After multiple uses, the porous silicon substrate regeneration procedure comprised rinsing surfaces with DI $H_2O$ and methanol sequentially and finally, immersing the substrate overnight in methanol/$H_2O$ mixture (volume ratio 1:2). The surfaces were then rinsed with DI $H_2O$ followed by methanol, and permitted to dry before applying the analyte.

Irradiating The Sample

Once a sample containing analyte has been introduced (or loaded or deposited) to a suitable substrate, the analyte is ready for desorption and ionization. The desorption and ionization of the analyte requires a source of electromagnetic radiation. The source of electromagnetic radiation provides radiation that the substrate can absorb and use to desorb and ionize the analyte. For a porous silicon substrate, the source of electromagnetic radiation is preferably an ultraviolet pulse laser. It is also preferable is that the ultraviolet pulse laser be focussed on the portion of the substrate containing the analyte.

A preferred method of illuminating the sample uses 128 laser shots from a 337 nm pulsed nitrogen laser (Laser Science, Inc.), with a power of 2 to 50 $\mu$J/pulse, as is normal for apparatus used for MALDI studies. In addition, as is normal for MALDI studies, the irradiation of the substrate occurs while the substrate is under reduced pressure. Irradiation is normally done with a lens, and with an optional neutral density filter, such methods of focussing and filtering laser radiation being known to those skilled in the art.

The reduced pressure can vary substantially depending on the sensitivity desired. All pressure ranges at which MALDI-MS can operate are encompassed by the present invention, as well as higher pressures acceptable because of the improved sensitivity and lesser problems with interference of the present technique. Pressures of the $10^{-6}$ torr to $10^{-7}$ torr are typical in many varieties of mass spectrometry, and the present invention works well at such pressures. Higher reduced pressures can be used, up to $10^{-2}$ torr, albeit with reduced instrumental sensitivity as the pressure rises. Lower reduced pressures, can provide benefits to sensitivity, and are encompassed by the present invention. Current technology can readily achieve pressures as low as $10^{-11}$ torr. However, the sensitivity improvements realized rarely justify the inconvenience and expense of such extremely low pressures.

When performing mass spectrometry, the substrate containing the analyte is held at a positive voltage during illumination. The positive voltage relative to the rest of the spectrometer is used to push newly formed positive ions away from the substrate and towards the mass analyzer or detector. Repelling the positive ions with positive voltage is preferred because the ions are formed by proton transfer. A preferred voltage range for the substrate is from about +5,000 to about +30,000 volts. Even more preferably, the sample is held at approximately +20,000 volts.

The analyte ions produced by the irradiation are Bronsted acids, and suitable for use as such in gas phase reaction chemistry. Further, the ions produced are suitable for study by a wide variety of physical methods, illustratively including electromagnetic spectroscopy, nuclear magnetic resonance, and chromatography. Methods of directing formed ions for use by physical methods other than mass spectrometry will be apparent to those skilled in the relevant arts.

Not wishing to be bound by theory, it is thought that the energy for analyte release from the substrate is transferred from silicon to the trapped analyte through vibrational pathways. It is also believed that rapid heating of porous silicon producing $H_2$ as observed by Ogata, et al, *J. Electrochem. Soc.* 145, 2439 (1998), releases the analyte. Alternatively, because porous silicon is known to absorb hydrocarbons from air or while under reduced pressure as reported by Canham in *Properties of Porous Silicon* (ed. Canham, L.T.) 44–50; 154–157 (The Institution of Electrical Engineers, London, 1997), rapid heating/vaporization of trapped hydrocarbon contaminants or solvent molecules can augment the vaporization and ionization of the analyte embedded in the porous silicon. The observation of DIOS-MS background ions (less than m/z 100) at high laser intensities, consistent with aliphatic hydrocarbons, indicate that ambient aliphatic hydrocarbons can play a role in the desorption and ionization of the analyte.

The Advantageous Detection of The Ionized Analyte In Mass Spectrometry

The ionized analyte created by the irradiation is especially well suited for use in mass spectrometry. Mass spectrometry can use a variety of apparatus to measure the mass to charge ratio of the ionized analyte. A time-of-flight detector is the preferred detector for measuring the desorbed and ionized analyte, and even more preferably, the time-of-flight mass analyzer is preceded by an ion reflector to correct for kinetic energy differences among ions of the same mass. Another preferred enhancement of the time of flight mass analyzer is realized when there is a short, controlled, delay between the desorption and ionization of the analyte and the application of the initial acceleration voltage by the mass analyzer. Another preferred embodiment of the invention uses the ion reflector to perform post source decay measurements on the desorbed, ionized, and reflected analyte.

An advantage of DIOS in the detection of analyte is the ability to perform measurements without a matrix, such as that present in MALDI. The ability to perform measurements without a matrix makes DIOS more amenable to small molecule analysis. In the absence of a matrix, a contemplated method completely avoids the low-mass interference that a matrix normally offers. FIGS. 3(*a*)&(*b*) depict mass spectrometry measurements of a WIN antiviral drug using DIOS-MS and MALDI-MS respectively. Details on the WIN antiviral drug are provided by Smith, et al, *Science*, 233 pp.1286–1293 (1986). The DIOS MS produces a clear signal of the molecular ion of the WIN drug. In contrast, MALDI-MS produces a very cluttered spectrum in which the signal from the WIN antiviral drug must compete with many large matrix peaks.

The inset spectrum on FIG. 3(*a*) is a PSD (Post Source Decay) study using DIOS. Fragmentation products of the molecular ion of the WIN antiviral drug are visible in the spectrum. The PSD small molecule measurements are ordinarily impossible to perform with a MALDI reflectron instrument due to the matrix interference displayed in FIG. 2(*b*). As the FIG. 2(*a*) inset mass spectrum shows, DIOS-MS can make PSD measurements. DIOS does all of this while obtaining a resolution in the analysis of compounds identical to MALDI analyses, whether the DIOS measurements are direct ones as in the main mass spectrum in FIG. 1(*a*), or PSD fragmentation measurements.

Other mass analyzers, including magnetic ion cyclotron resonance instruments, deflection instruments, and quadrupole mass analyzers are within the scope of the invention.

DIOS-MS can be performed on porous silicon substrates with a broad range of analytes. Over thirty other compounds ranging in size from 150 to 12,000 Daltons, including carbohydrates, peptides, glycolipids, natural products, and small drug molecules were studied and their molecular ion observed with little or no fragmentation proving that DIOS is useful for a large variety of biomolecules. The molecules studied included: caffeine (195 Da), the antiviral drug WIN (structure depicted below),

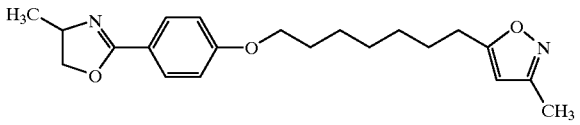

N-octyl β-D-glucopyranoside, pleconaril, L-tryptophan, fucose, N-acetylethyleneimine, 4-chlorobenzonichydrazide, 26-hydroxy-15-des-methylepothilene B ($C_{26}H_{39}NO_7S$), corn oil (mixtures of seven triglicerides), combinatorial libraries mixtures with approximately 15 different compounds, HP tuning mix (a seven molecule mix sold by Hewlett-Packard for tuning ESI mass spectrometers), a synthetic polymer, MRFA, des-arg-bradykinin, bradykinin, angiotensin, ACTH, Insulin B, bovine serum albumin, phosphopeptides, and about twenty other synthetic organic molecules.

Analytes were generally dissolved in a deionized $H_2O$ or $H_2O$ methanol mixture at concentrations typically ranging from 0.001 to 10.0 μM. Aliquots (0.5–1.0 μl; corresponding to 0.5 femtomoles to 100 picomoles of analyte) of the solution were directly deposited onto the porous substrates and permitted to dry before DIOS-MS analysis. The loaded (or deposited) analytes were then normally redissolved by placing 0.5 μL of methanol/water at a 1:2 (v/v) ratio on the sample and permitted to redry.

Peptides generated a good signal from the deposition of 700 attomoles of material and permitted analyte analysis even in a saturated salt solution. For instance, spectra of des-arg-bradykinin (shown in FIGS. 4(*a*)–(*d*)) were easily obtained from saturated $K_3PO_4$, 2.0M NaCl, and 2.0M TRIS solutions, although higher laser intensities were required for these analyses.

For analytes too large to study by DIOS, matrix-assisted DIOS is an improvement over conventional MALDI techniques as is demonstrated by FIGS. 5(*a*)–(*c*), expanding the benefits of the technique to even more compounds.

The DIOS, matrix-assisted DIOS, MALDI, and laser desorption studies discussed herein were performed on a Voyager DE-STR, time-of-flight mass spectrometer (PerSeptive Biosystems, Inc., Framingham, Mass.) using a pulsed nitrogen laser (Laser Science Inc.) operated at 337 nm.

EXAMPLES

Example 1

Production of a porous silicon wafer with 25 well plates

A wafer with a 5×5 array of well plates composed of porous silicon can be prepared from n-type silicon. A P-doped, (100) orientation, 0.65 Ω·cm resistivity Si wafer with an area of 1.1 $cm^2$ can serve as the anode, and can be placed in contact with an aluminum tongue. The wafer can then etched for 2 minutes in a single electrochemical cell using a +71 $mA/cm^2$ current density in a 1:1 solution of EtOH/49% HF(aq), while the solution is in contact with a platinum cathode located 2 mm above the wafer's surface. During the etching, the wafer is illuminated by a 300 W tungsten filament bulb (ELH W, General Electric, standard projector bulb) through a mask and an f/50 reducing lens to form porous silicon in the illuminated areas. A light intensity incident of 22.4 $mW/cm^2$, as measured by a light meter, effectively facilitates the etching. The white light shining through the lens and the mask illuminates the silicon wafer with a 5×5 array of 500 micron spots of white light. The silicon etches and anodizes where the light is shining. After anodization, the wafer can be washed with ethanol and blown dry under a nitrogen stream.

Example 2

Production of a porous silicon wafer with one side completely porous

To prepare an unpatterned porous silicon wafer from p-type silicon, a B-doped, (100) orientation, 0.01 Ω·cm resistivity Si wafer with an area of 1.1 cm2 is etched as in Example 1, at 37 $mA/cm^2$ current density in the dark for 3 h.

Example 3

Functionalizing a porous silicon wafer with an ethyl phenyl functional group via a Lewis acid-mediated hydrosilylation To functionalize a porous silicon wafer with an ethyl phenyl group via Lewis acid-mediated hydrosilylation, an etched wafer as in Example 1 is placed in a glove box with a nitrogen atmosphere. 400 μL (400 μmol) of a 1.0 M ethyl aluminum dichloride solution (25,161-5 or 25,692-7 from Aldrich P.O. Box 2060 Milwaukee, Wis. 53201) is placed on the wafer followed by 56 μmol of styrene (24,086-9 from Aldrich), and the reaction is permitted to run for 12 hours. When the reaction is complete, the substrate is coated with a phenyl ethyl group. After the reaction is finished, the surface is cleaned by rinsing with tetrahydrofuran.

Example 4

Functionalizing a porous silicon wafer with a dodecyl functional group via a Lewis acid-mediated hydrosilylation To functionalize a porous silicon wafer with a dodecyl termination, the procedure of example 3 is used, using 1-dodecene instead of styrene. The resultant surface is hydrophobic.

Example 5

Functionalizing a porous silicon wafer with 3-butyne-1-ol via a Lewis acid mediated hydrosilylation To functionalize a porous silicon wafer with a 4-hydroxy-1-butenyl group, an etched wafer as in Example 1 is placed in a glove box with a nitrogen atmosphere. 40 μL (40 μmol) of a 1.0M ethyl aluminum dichloride solution is placed on the wafer followed by 56 μmol of 3-butyne-1-ol (13,085-0 from Aldrich), and the reaction is permitted to run for 2 hours. When the reaction is complete, the substrate is coated with a hydrophilic 4-hydroxy-1-butenyl group. The resultant substrate is hydrophilic. After the reaction finishes, the surface is cleaned by rinsing with tetrahydrofuran, ethanol, and methylene chloride.

Example 6

Functionalizing a porous silicon wafer with 5-cyano-1-pentyne via a Lewis acid mediated hydrosilylation To functionalize porous silicon with 5-cyano-1-pentenyl the procedure of Example 5 is used substituting 5-cyano-1-pentyne (Aldrich, 27,134-9, as 5-hexynenitrile) for 3-butyne-1-ol. The resultant surface is hydrophilic.

Example 7

Functionalizing a silicon wafer with an ethyl phenyl functional group via light activated hydrosilylation To functionalize the etched wafer from Example 1 via light-activated hydrosilylation, the wafer, still in the etching cell, can be placed in a glove box with a nitrogen atmosphere. 400 $\mu$L of styrene is then added to the surface of the wafer directly. A CHEMGLASS window (borosilicate) can be sealed with a VITON O-ring over the etching cell reservoir and clamped. The lamp used in the etching of the wafer can then be used as a light source with an intensity of 22.4 mW/cm$^2$ at the sample. The reaction usually takes 30 minutes, but is dependent on the light intensity from the etching lamp.

Example 8

Functionalizing a silicon wafer with a fluorophilic functional group via light activated hydrosilylation To functionalize an etched wafer with a fluorophilic functional group, the procedure of Example 7 is used substituting 3,3,4,4,5,5,6,6,7,7, 8,8,9,9,10,10,10-heptadecafluoro-1-decene (Aldrich, 37,057-6) for styrene. The resulting fluorophilic wafer is non-spreading to both hydrophilic and hydrophobic solvents.

Example 9

Functionalizing the silicon wafer with an oxide coating using potassium hydroxide The wafer from Example 1 can be given an oxide termination by being placed in a potassium hydroxide solution with a pH value of 12, and illuminating the wafer with a 300 W tungsten filament light bulb providing 100 mW/cm$^2$ of illumination, as measured by a light meter, for 15 seconds. The wafer can then be removed from solution and rinsed with first with deionized water, and then with methanol. The wafer can then be permitted to dry. The oxidized wafer is hydrophilic.

Example 10

A DIOS-MS spectrum of a mixture of peptides

Four porous silicon wafers made as in Example 3 can be mounted inset on a commercially available MALDI plate without added matrix. FIG. 1(*a*) depicts four n-type porous silicon plates placed on a MALDI plate, each containing photopatterned spots or grids. The porous silicon plates can be attached to the MALDI plate with adhesive tape.

Each of five peptides: a four residue peptide met-arg-phe-ala (MRFA) at m/z 524, des-arg-bradykinin (m/z 905), bradykinin (m/z 1061), angiotensin (m/z 1297), and ACTH (m/z 2466) are dissolved in a 1:1 $H_2O$/methanol mixture at a concentration 2.0 $\mu$M. An aliquot of 1.0 $\mu$l of the mixture is directly deposited onto a 500 micron porous silicon well and permitted to dry. After drying the substrate is an analyte-loaded substrate where the analyte is a mixture of five peptides. The deposited material is then redissolved by placing 0.5 $\mu$L of methanol/water at a 1:2 v/v ratio on the sample and the sample is permitted to redry. The MALDI plate with the sample is then placed in a Voyager DE-STR, time-of-flight mass spectrometer (PerSeptive Biosystems, Inc., Framingham, Mass.).

The sample is then irradiated with 128 laser shots using a nitrogen laser (337 nm) with a laser intensity of 5 $\mu$J/pulse. The results of the 128 lasings are averaged to produce the final spectrum. Once formed, the ions are accelerated into the time-of-flight mass analyzer by a voltage of +20,000 volts applied to the substrate.

The mass spectrum in FIG. 2(*a*) is a DIOS mass spectrum of the five-peptide mixture. Each of the five peptides appears clearly on the spectrum: the MRFA at m/z 524, des-arg-bradykinin at m/z 905, bradykinin at m/z 1061, angiotensin m/z 1297, and ACTH m/z 2466. The small peaks at m/z 540 and m/z 1320 are oxidized MRFA and a sodium adduct of angiotensin, respectively. The signal of m/z 70 corresponds to a surface background ion (possibly $C_5H_{10}^+$).

The expanded insert spectrum in FIG. 2(*a*) shows the isotopes of angiotensin and that the resolution is not affected by the porous silicon substrate. The strength of the peaks for the molecular ions at m/z 524, 905, 1061, 1297, and 2466, with little or no fragmentation, silicon interference, or ethyl phenyl interference demonstrates the power of the technique for analyzing samples of mixed species.

Example 11

DIOS of a mixture of three small molecules

FIG. 2(*b*) is the DIOS mass spectrum, as per Example 10, of a mixture of three small molecules, including 1 pmol each of caffeine (m/z 196), an antiviral drug, WIN (m/z 357) (detailed in Smith, et al, *Science* 233 p.1286–1293 (1986)) and reserpine (m/z 609). The decrease in quantity of sample deposited is achieved by halving the volume of the aliquot of sample deposited. A small signal indicated with * is an impurity from caffeine. Again, the molecular ions of the species studied dominate the spectrum.

Example 12

DIOS of the sodium salt of N-octyl β-D-glucopyranoside

FIG. 2(*c*) is the DIOS mass spectrum, as per Example 10, of 10 pmol of the sodium salt of N-octyl β-D-glucopyranoside(m/z 293 for the plain ion and m/z 315 for the sodium adduct) is deposited on the substrate. The increase in the quantity of sample deposited is achieved by increasing the concentration of the sample solution by a factor of five. Both the molecular ion and the sodium adduct ion appear clearly in the mass spectrum, with very little signal from other ions. The sodium ion (m/z 23) itself is also detected.

Example 13

Comparison of DIOS, MALDI, and laser desorption/ionization using the antiviral drug WIN FIG. 3 depicts comparative analyses of the WIN antiviral drug using different desorption/ionization techniques on 500 fmol of sample.

First, 500 fmol of WIN is introduced to a porous silicon substrate as per Example 11, by introducing 0.5$\mu$l of a 1.0 $\mu$M solution of WIN to the porous silicon. The result is a WIN-loaded, or analyte-loaded, substrate. The study is otherwise conducted as Example 10. FIG. 3(*a*) depicts the DIOS mass spectrum of WIN. Accurate mass measurements are obtained on WIN with the time-of-flight reflectron instrument to within 10 ppm (the limit of accuracy of this instrument in this mass range). As can be seen in FIG. 3(*a*) the DIOS mass spectrum is substantially all the protonated version of WIN without any fragmentation pattern. The inset spectrum represents post-source decay (PSD) fragmentation measurements performed on WIN drug.

Second, a 0.5 μl aliquot of the WIN solution as above is introduced to a standard, gold substrate, MALDI plate. Then, 0.5 μl of a saturated solution of α-cyano-4-hydroxycinnamic matrix material in 1:1 $H_2$)/methanol is introduced to the WIN aliquot. The liquids are mixed and permitted to dry. The study is then conducted as in Example 10, absent the sample preparation steps. In contrast to the clean mass spectrum of the DIOS analysis, FIG. 3(*b*) depicts the results of the MALDI study. The signal from the WIN molecule is at an m/z of 357. As can be seen, by comparing FIG. 3(*a*) and 3(*b*), an advantage of the present invention is that the ability to perform these measurements without a matrix also makes the present invention more amenable to small molecule analysis. When not using a matrix, the present invention completely avoids the low-mass interference that a matrix normally offers.

Third, a study is done where a 500 fmol sample of WIN is prepared as for the DIOS study, and introduced to a standard, gold substrate, MALDI plate. The study is otherwise conducted as in Example 10. FIG. 3(*c*) shows that no signal is obtained for WIN (or for that matter from any other compound studied) using laser desorption mass spectrometry off of the gold MALDI plate.

Example 14

Studies of small samples of des-arg-bradykinin

FIGS. 4(*a*)–(*b*) depict the DIOS mass spectra of the tripeptide des-arg-bradykinin with small sample quantities. and in the presence of salt in FIGS. 4(*c*)&(*d*).

First, the DIOS mass spectra FIG. 4(*a*) depicts a spectrum obtained from a sample of 7 fmol des-arg-bradykinin. Using the procedure in Example 10, 0.5 μl of a 14 nM (nanomolar) solution is introduced to the substrate. Even with a tiny amount of sample, the molecular ion is clearly detected.

Second, FIG. 4(*b*) depicts a spectrum of substantially the same shape with at a mere 700 attmol, introduced as in Example 10 using 0.5 μl of a 1.4 nM solution of des-arg-bradykinin. The importance of forming the molecular ion cleanly with little or no fragmentation or interference is apparent in FIG. 4(*b*) where at the attomole level a fragmented signal can well be lost in the noise. The sensitivity of DIOS for des-arg-bradykinin demonstrates that DIOS is a sensitive technique for desorption/ionization of biomolecules at the femtomole (fmol, $10^{-15}$ moles) and attomole (attmol, or $10^{-18}$ moles) level with little or no fragmentation, in contrast to what is typically observed with other direct desorption/ionization approaches.

Example 15

Studies of des-arg-bradykinin in salt and buffer solutions

FIGS. 4(*c*)–(*d*) depict the DIOS mass spectra of the tripeptide des-arg-bradykinin in the presence of salt in FIG. 4(*c*), and in the presence of a buffer in FIG. 4(*d*).

First, FIG. 4(*c*) depicts the result from a 2 pmol sample in the presence of a 2M NaCl. A 1.0 μl aliquot of 2.0 μM solution of des-arg-bradykinin in 2M aqueous NaCl is introduced, and the study performed similarly to Example 10, except that a higher laser intensity of 100 μJ is used. Both the protonated version and sodium salt of des-arg-bradykinin are clearly visible in FIG. 4(*c*).

Second, FIG. 4(*d*) depicts the result from a 2 pmol sample in the presence of a saturated K3PO4 solution. The study is done as in the NaCl study, except that the 1.0 μl aliquot of 2.0 μM solution of des-arg-bradykinin is saturated in K3PO4 instead of having NaCl. Both the protonated version and the potassium salt of des-arg-bradykinin are clearly visible in FIG. 4(*d*).

FIGS. 4(*c*) & (*d*) demonstrate the present invention works well on samples with high concentrations of salts and buffers, and can be 100 times more tolerant of salts than the MALDI or ESI desorption/ionization techniques, which is an important advantage in biomolecular analysis.

Example 16

Matrix-Assisted DIOS compared to MALDI

FIG. 5 depicts a comparison between matrix-assisted DIOS and MALDI.

First, a three-protein mixture is studied on porous silicon as follows. A three-protein solution is prepared having a concentration of 5.0 μM of each cytochrome C, myoglobin, and bovine serum albumin (BSA) in 1:1 $H_2O$/methanol. As per White, et al, *Principles of Biochemistry* (McGraw-Hill 6th ed. 1978), the masses of the proteins are: cytochrome C, approximately 11,700; myoglobin, approximately 17,900; BSA, approximately 68,000. Then, a 0.5 μL aliquot of the solution is introduced to a porous silicon wafer as in Example 10 and permitted to dry. A 0.5 μL aliquot of a saturated solution of sinapinic acid in water/acetonitrile (1:1 v/v) with 0.1% TFA, is then introduced onto the dried protein mixture and permitted to dry. The protein mixture is then studied as in Example 10. FIG. 5(*a*) is the matrix-assisted DIOS spectrum of the mixed sample of cytochrome C, myoglobin, and bovine serum albumin (BSA). The molecular ion of each of the components is clearly visible with the only significant competition coming from the doubly charged BSA, which has an m/z at half the molecular weight of BSA because of a double charge.

Second, 0.5 μL of the three-protein solution and 0.5 μL of a saturated sinapinic acid are deposited and mixed on the MALDI target and then permitted to dry. The protein mixture is then studied as in Example 10. FIG. 5(*b*) is a standard MALDI mass spectrum of the three-protein mixture.

As can be seen by a comparison of FIGS. 5(*a*)&(*b*), the matrix-assisted DIOS is more than three times more sensitive than MALDI for BSA. The location of the signal peak is also more accurate using matrix-assisted DIOS than MALDI. The matrix-assisted DIOS detects the protonated version of BSA, whereas MALDI detects the BSA at a mass significantly higher than the molecular ion. The significantly lower m/z and higher resolution for BSA with matrix-assisted DIOS show that for the analysis of BSA, matrix-assisted DIOS is clearly the superior technique.

FIG. 5(*c*), which compares the BSA peaks from FIGS. 5(*a*)& 5(*b*) shows how the MALDI peak is a shifted and broadened version of the DIOS peak. The contrast between the BSA measurements of DIOS and MALDI demonstrates yet another benefit of the present invention in that in addition to being capable of directly detecting analytes without a matrix, the present invention can be used with a matrix-bound analyte deposited on the surface to detect analytes of molecular weights up to and over 12,000 with the aid of the matrix, while exhibiting less matrix interference than conventional matrix-assisted techniques.

From the foregoing, it will be observed that numerous modifications and variations can be effectuated without departing from the true spirit and scope of the novel concepts of the present invention. It is to be understood that no limitation with respect to the specific embodiment illustrated is intended or should be inferred. The disclosure is intended to cover by the appended claims all such modifications as fall within the scope of the claims.

We claim:

1. A method for providing an analyte ion suitable for analysis of a physical property comprising the steps of:

(a) providing a porous light-absorbing semiconductor substrate;

(b) contacting a quantity of an analyte having a physical property to be determined with said substrate to form an analyte-loaded substrate; and (c) irradiating the analyte-loaded substrate under reduced pressure to provide an ionized analyte, wherein, once ionized under reduced pressure, the analyte ion is suitable for analysis to determine a desired physical property.

2. The method of claim 1 wherein the analyte has a concentration of salts greater than 10 millimolar.

3. The method of claim 1 wherein the analyte is free of a matrix.

4. The method of claim 1 wherein the analyte is adsorbed on the substrate.

5. The method of claim 1 wherein the quantity of analyte is less than 1 femtomole.

6. The method of claim 1 wherein the reduced pressure is that of a mass spectrometer.

7. The method of claim 1 wherein the reduced pressure is $10^{-6}$ torr or less.

8. The method of claim 1, wherein the analyte is substantially free of a light-absorbing matrix.

9. A method for providing an analyte ion suitable for analysis of a physical property comprising the steps of:

(a) providing a porous light-absorbing semiconductor substrate having a saturated carbon atom bonded to the substrate;

(b) contacting a quantity of an analyte having a physical property to be determined with said substrate to form an analyte-loaded substrate;

(c) placing the analyte loaded-substrate under reduced pressure;

(d) irradiating the analyte-loaded substrate with an ultraviolet laser under reduced pressure to provide an ionized analyte, wherein, once ionized under reduced pressure, the analyte ion is suitable for analysis to determine a desired physical property.

10. The method of claim 9 wherein the porous semiconductor substrate is irradiated with light having a wavelength of approximately 337 nm.

11. The method of claim 9, wherein the analyte is substantially free of a light-absorbing matrix.

12. A method for determining a physical property of an analyte ion, the method comprising the steps of:

(a) providing a porous light-absorbing semiconductor substrate;

(b) contacting a quantity of an analyte having a physical property to be analyzed with said substrate to form an analyte-loaded substrate;

(c) irradiating the analyte-loaded substrate under reduced pressure to provide an ionized analyte; and (d) analyzing the ionized analyte for the physical property, wherein analysis of the analyte comprises one or more physical methods that permit the material to be identified.

13. The method of claim 12 wherein the physical property of the analyte and the physical property analyzed is the mass to charge ratio (m/z) of the ionized analyte by a mass spectrometry technique.

14. The method of claim 12, wherein the analyte is substantially free of a light-absorbing matrix.

15. An apparatus for providing an ionized analyte for analysis comprising:

a porous light absorbing substrate;

a source of radiation, such that when the source of radiation irradiates the substrate under reduced pressure and an analyte is adsorbed on the substrate, the substrate absorbs the radiation and desorbs and ionizes the analyte for analysis.

16. The apparatus of claim 15 wherein the porous substrate comprises a metal.

17. The apparatus of claim 15 wherein the porous substrate comprises a semi-metal.

18. The apparatus of claim 15 wherein the porous substrate comprises a semiconductor.

19. The apparatus of claim 15, wherein the analyte is substantially free of a light-absorbing matrix.

20. An apparatus for providing an ionized analyte for analysis comprising:

a porous light-absorbing semiconductor substrate;

a source of radiation, such that when the source of radiation irradiates the substrate under reduced pressure and an analyte is adsorbed on the substrate, the irradiation causes the desorption and ionization of the analyte for analysis.

21. The apparatus of claim 20 wherein the porous substrate is oxidized.

22. The apparatus of claim 20 wherein the porous substrate has a hydrophobic surface coating.

23. The apparatus of claim 20 wherein the porous substrate has a hydrophilic surface coating.

24. The apparatus of claim 20 wherein the porous substrate has a fluorophilic surface coating.

25. The apparatus of claim 20 wherein saturated carbon atoms are bonded to the porous substrate.

26. The apparatus of claim 25 wherein ethyl phenyl groups are bonded to the porous substrate.

27. The apparatus of claim 20 wherein the porous substrate is modified to optimize the ionization and desorption characteristics.

28. The apparatus of claim 27 wherein the porous substrate is chemically modified to prevent spreading of the analyte.

29. The apparatus of claim 20 wherein the porous substrate is microporous.

30. The apparatus of claim 20 wherein the porous substrate is macroporous.

31. The apparatus of claim 20 wherein the porous substrate is mesoporous.

32. The apparatus of claim 20 wherein the porous substrate is an n-type semiconductor.

33. The apparatus of claim 20 wherein the porous substrate is a p-type semiconductor.

34. The apparatus of claim 20 wherein the porous substrate comprises Si.

35. The apparatus of claim 34 wherein the porosity of the substrate is about 4% to about 100%.

36. The apparatus of claim 34 wherein the porosity of the substrate is about 50% to about 80%.

37. The apparatus of claim 34 wherein the porosity of the substrate is about 60% to about 70%.

38. The apparatus of claim 34 wherein the specific surface area of the porous substrate is about 1 to about 1000 meters squared per gram.

39. The apparatus of claim 34 wherein the specific surface area of the porous substrate is about 600 to about 800 meters squared per gram.

40. The apparatus of claim 34 wherein the specific surface area of the porous substrate is approximately 640 meters squared per gram.

41. The apparatus of claim 20, wherein the analyte is substantially free of a light-absorbing matrix.

42. An apparatus for identifying the mass of an analyte comprising:

a porous light-absorbing substrate;

a source of radiation, such that when the source of radiation irradiates the substrate under reduced pressure and an analyte having a mass is adsorbed on the substrate, the substrate absorbs the radiation and desorbs and ionizes the analyte for analysis, and a mass analyzer that analyzes the mass to charge ratio (m/z) of the ionized and desorbed analyte.

43. The apparatus of claim 42 wherein a source of positive voltage is connected to the porous substrate.

44. The apparatus of claim 34 wherein a voltage of about 5000 to about 30,000 volts is applied to the porous substrate.

45. The apparatus of claim 42, wherein the analyte is substantially free of a light-absorbing matrix.

46. An apparatus for identifying the mass of an analyte comprising:

a porous substrate, said substrate being coated with a substance having a saturated carbon atom bond;

a source of ultraviolet radiation, such that when the source of radiation irradiates the substrate under reduced pressure and an analyte having a mass is adsorbed on the substrate, the irradiation causes the desorption and ionization of the analyte for analysis; and a mass analyzer that analyzes the mass to charge ratio (m/z) of the ionized and desorbed analyte.

47. The apparatus of claim 46 wherein the mass analyzer is a time-of-flight mass spectrometer.

48. The apparatus of claim 46 further comprising a reflector to conduct post-source decay measurements.

49. The apparatus of claim 46, wherein the analyte is substantially free of a light-absorbing matrix.

50. An apparatus for identifying the mass of an analyte comprising:

a porous semiconductor substrate;

a laser source of radiation, such that when the source of radiation irradiates the substrate under reduced pressure and an analyte having a mass is adsorbed on the substrate, the irradiation causes the desorption and ionization of the analyte for analysis; and a mass analyzer that analyzes the mass to charge ratio (m/z) of the ionized and desorbed analyte.

51. The apparatus of claim 50, wherein the analyte is substantially free of a light-absorbing matrix.

52. A method for identifying an analyte ion, the method comprising the steps of:

(a) providing a porous, light-absorbing, silicon semiconductor substrate with a porosity of about 60% to about 70% with ethyl phenyl groups bonded thereto;

(b) contacting a quantity of an analyte free of matrix molecules having a mass to be analyzed with said substrate to form an analyte-loaded substrate;

(c) applying a positive voltage of about 5,000 to about 34,000 volts to the analyte-loaded substrate;

(d) irradiating the analyte-loaded substrate under reduced pressure with an ultraviolet laser to provide an ionized analyte; and (e) analyzing the mass to charge ratio (m/z) of the ionized analyte by time-of-flight mass spectrometry techniques.

53. The method of claim 52, wherein the analyte is substantially free of a light-absorbing matrix.

54. An apparatus for providing an ionized analyte for analysis comprising:

a porous silicon semiconductor substrate, the substrate having a porosity of about 60% to about 70% whose surface is bonded to ethyl phenyl groups;

a source of positive voltage that provides about 5,000 to about 30,000 volts of potential, connected to the substrate;

an ultraviolet laser source of radiation, such that when an analyte having a mass is adsorbed on the substrate, the source of radiation irradiates the substrate under a reduced pressure of less than $10^{-6}$ torr causing the desorption and ionization of the analyte for analysis; and a time-of-flight mass spectrometer to analyze the mass to charge ratio (m/z) of desorbed and ionized analyte.

55. The apparatus of claim 54, wherein the analyte is substantially free of a light-absorbing matrix.

56. A method for determining the mass of an analyte comprising providing a substrate, contacting the substrate with an analyte having a mass, irradiating the substrate with a source of radiation wherein illumination of the substrate causes the ionization and desorption of the analyte, repelling the ionized and desorbed analyte from the substrate with a positive voltage, and analyzing the repelled analyte for its mass to charge ratio (m/z) wherein the improvement comprises:

a light-absorbing porous semiconductor substrate.

57. The method of claim 56, wherein the analyte is substantially free of a light-absorbing matrix.

58. An apparatus for determining the mass of an analyte comprising a substrate, an analyte having a mass contacting the substrate, a source of radiation irradiating the substrate wherein illumination of the substrate causes the ionization and desorption of the analyte, a source of positive voltage connected to the substrate that repels the desorbed and ionized analyte, and a spectrometer that analyzes the mass to charge ratio (m/z) of the repelled analyte wherein the improvement comprises:

a substrate is a light-absorbing porous semiconductor.

59. The apparatus of claim 58, wherein the analyte is substantially free of a light-absorbing matrix.

60. A sample holder configured for use in providing an ionized analyte for analysis by mass spectrometry comprising:

a silicon wafer having at least one porous photoluminescent region, and a hydrophobic coating on the porous photoluminescent region.

61. A method of improving the detection an analyte via laser desorption mass spectrometry comprising the steps of:

providing a substrate having a hydrophobic hydride coated sample loading region;

providing an analyte dissolved in a first liquid as a sample;

contacting the coated sample loading region with the sample wherein the sample does not spread on the coated sample loading region to form a sample loaded substrate; and removing the first liquid from the sample loaded substrate to form an analyte loaded substrate.

62. A method of improving the detection an analyte via laser desorption mass spectrometry comprising the steps of:

providing a substrate having a coated sample loading region, wherein the coating is bonded to the substrate at a saturated carbon atom;

providing an analyte dissolved in a first liquid as a sample;

contacting the coated sample loading region with the sample wherein the sample does not spread on the coated sample loading region to form a sample loaded substrate; and removing the first liquid from the sample loaded substrate to form an analyte loaded substrate.

63. The method of claim 62 wherein the coating comprises ethyl phenyl groups.

64. A method of improving the detection an analyte via laser desorption mass spectrometry comprising the steps of:

providing a substrate having a coated sample loading region, wherein the coating comprises a hydrophilic oxide of the substrate;

providing an analyte dissolved in a first liquid as a sample;

contacting the coated sample loading region with the sample wherein the sample does not spread on the coated sample loading region to form a sample loaded substrate; and removing the first liquid from the sample loaded substrate to form an analyte loaded substrate.

65. A method of improving the detection an analyte via laser desorption mass spectrometry comprising the steps of:

providing a substrate having a fluorophilic coated sample loading region;

providing an analyte dissolved in a first liquid as a sample;

contacting the coated sample loading region with the sample wherein the sample does not spread on the coated sample loading region to form a sample loaded substrate; and removing the first liquid from the sample loaded substrate to form an analyte loaded substrate.

* * * * *